US009863025B2

(12) United States Patent
Na et al.

(10) Patent No.: US 9,863,025 B2
(45) Date of Patent: Jan. 9, 2018

(54) BULK NICKEL-PHOSPHORUS-BORON GLASSES BEARING MANGANESE, NIOBIUM AND TANTALUM

(71) Applicant: Glassimetal Technology, Inc., Pasadena, CA (US)

(72) Inventors: Jong Hyun Na, Pasadena, CA (US); Danielle Duggins, Garden Grove, CA (US); Michael Floyd, Pasadena, CA (US); Glenn Garrett, Pasadena, CA (US); Maximilien Launey, Pasadena, CA (US); Marios D. Demetriou, West Hollywood, CA (US); William L. Johnson, San Marino, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 686 days.

(21) Appl. No.: 14/458,091

(22) Filed: Aug. 12, 2014

(65) Prior Publication Data

US 2015/0047755 A1 Feb. 19, 2015

Related U.S. Application Data

(60) Provisional application No. 61/866,743, filed on Aug. 16, 2013.

(51) Int. Cl.
*C22C 45/04* (2006.01)
*C22F 1/00* (2006.01)
(Continued)

(52) U.S. Cl.
CPC ..... *C22F 1/002* (2013.01); *C22C 1/002* (2013.01); *C22C 1/023* (2013.01); *C22C 19/03* (2013.01); *C22C 45/04* (2013.01); *C22F 1/10* (2013.01)

(58) Field of Classification Search
None
See application file for complete search history.

(56) References Cited

U.S. PATENT DOCUMENTS 3,856,513 A 12/1974 Chen et al.
4,116,682 A 9/1978 Polk et al.
(Continued)

FOREIGN PATENT DOCUMENTS

CN 1354274 6/2002
CN 1653200 8/2005
(Continued)

OTHER PUBLICATIONS

Habazaki et al., "Preparation of corrosion-resistant amorphous Ni—Cr—P—B bulk alloys containing molybdenum and tantalum," *Material Science and Engineering*, A304-306, 2001, pp. 696-700.
(Continued)

*Primary Examiner* — George Wyszomierski
(74) *Attorney, Agent, or Firm* — Polsinelli PC

(57) ABSTRACT

The present disclosure is directed to Ni—P—B alloys and glasses containing small fractions of Nb and Ta and optionally Mn. Over a specific range, the alloys are capable of forming bulk metallic glasses having critical casting thickness in excess of 1 mm. In one embodiment, compositions with a Mn content of between 3 and 4 atomic percent, Nb content of about 3 atomic percent, B content of about 3 atomic percent, and P content of about 16.5 atomic percent, where the balance in Ni, were capable of forming bulk metallic glass rods with diameters as large as 5 mm or larger. In another embodiment, Ni-based compositions with a Mn content of between 5 and 7 atomic percent, Ta content of between 1 and 2 atomic percent, B content of about 3 atomic percent, and P content of about 16.5 atomic percent, where
(Continued)

the balance in Ni, were capable of forming bulk metallic glass rods with diameters as large as 5 mm or larger.

18 Claims, 23 Drawing Sheets

(51) Int. Cl.

| | |
|---|---|
| ***C22C 19/03*** | (2006.01) |
| ***C22F 1/10*** | (2006.01) |
| ***C22C 1/00*** | (2006.01) |
| ***C22C 1/02*** | (2006.01) |

(56) References Cited

U.S. PATENT DOCUMENTS

| | | | |
|---|---|---|---|
| 4,126,284 | A | 11/1978 | Ichikawa et al. |
| 4,144,058 | A | 3/1979 | Chen et al. |
| 4,152,144 | A | 5/1979 | Hasegawa et al. |
| 4,385,932 | A | 5/1983 | Inomata et al. |
| 4,385,944 | A | 5/1983 | Hasegawa |
| 4,582,536 | A | 4/1986 | Raybould |
| 4,892,628 | A | 1/1990 | Guilinger |
| 4,900,638 | A | 2/1990 | Emmerich |
| 4,968,363 | A | 11/1990 | Hashimoto et al. |
| 5,338,376 | A | 8/1994 | Liu et al. |
| 5,429,725 | A | 7/1995 | Thorpe et al. |
| 5,634,989 | A | 6/1997 | Hashimoto et al. |
| 6,004,661 | A | 12/1999 | Sakai et al. |
| 6,303,015 | B1 | 10/2001 | Thorpe et al. |
| 6,325,868 | B1 | 12/2001 | Kim et al. |
| 6,695,936 | B2 | 2/2004 | Johnson |
| 8,052,923 | B2 | 11/2011 | Langlet |
| 8,287,664 | B2 | 10/2012 | Brunner |
| 2005/0263216 | A1 | 12/2005 | Chin et al. |
| 2006/0213586 | A1 | 9/2006 | Kui |
| 2007/0175545 | A1 | 8/2007 | Urata et al. |
| 2009/0110955 | A1 | 4/2009 | Hartman et al. |
| 2012/0073710 | A1 | 3/2012 | Kim et al. |
| 2012/0168037 | A1 | 7/2012 | Demetriou et al. |
| 2013/0048152 | A1 | 2/2013 | Na et al. |
| 2013/0263973 | A1 | 10/2013 | Kurahashi et al. |
| 2014/0076467 | A1 | 3/2014 | Na et al. |
| 2014/0096873 | A1 | 4/2014 | Na et al. |
| 2014/0116579 | A1 | 5/2014 | Na et al. |
| 2014/0130942 | A1 | 5/2014 | Floyd et al. |
| 2014/0130945 | A1 | 5/2014 | Na et al. |
| 2014/0190593 | A1 | 7/2014 | Na et al. |
| 2014/0213384 | A1 | 7/2014 | Johnson et al. |
| 2015/0158126 | A1 | 6/2015 | Hartmann et al. |
| 2015/0159242 | A1 | 6/2015 | Na et al. |
| 2015/0176111 | A1 | 6/2015 | Na et al. |
| 2015/0197837 | A9 | 7/2015 | Schramm et al. |
| 2015/0240336 | A1 | 8/2015 | Na et al. |

FOREIGN PATENT DOCUMENTS

| | | |
|---|---|---|
| DE | 3929222 | 3/1991 |
| DE | 102011001783 | 10/2012 |
| DE | 102011001784 | 10/2012 |
| EP | 0014335 | 8/1980 |
| EP | 0161393 | 11/1985 |
| EP | 0260706 | 3/1988 |
| EP | 1077272 | 2/2001 |
| EP | 1108796 | 6/2001 |
| EP | 1522602 | 4/2005 |
| JP | 54-76423 | 6/1979 |
| JP | S55-148752 | 11/1980 |
| JP | S57-13146 | 1/1982 |
| JP | 63-079930 | 4/1988 |
| JP | 63079931 | 4/1988 |
| JP | 63-277734 | 11/1988 |
| JP | 1-205062 | 8/1989 |
| JP | 08-269647 | 10/1996 |
| JP | 11-71659 | 3/1999 |
| JP | 2001-049407 | 2/2001 |
| JP | 2007-075867 | 3/2007 |
| WO | WO 2012/053570 | 4/2012 |
| WO | WO 2013/028790 | 2/2013 |

OTHER PUBLICATIONS

Zhang et al., "The Corrosion Behavior of Amorphous Ni—Cr—P Alloys in Concentrated Hydrofluoric Acid," *Corrosion Science*, vol. 33, No. 10, pp. 1519-1528, 1992.

Katagiri et al., "An attempt at preparation of corrosion-resistant bulk amorphous Ni—Cr—Ta—Mo—P—B alloys," *Corrosion Science*, vol. 43, No. 1, pp. 183-191, 2001.

Habazaki et al., "Corrosion behaviour of amorphous Ni—Cr—Nb—P—B bulk alloys in 6M HCI solution," *Material Science and Engineering*, A318, 2001, pp. 77-86.

Murakami (Editor), *Stress Intensity Factors Handbook*, vol. 2, Oxford: Pergamon Press, 1987, 4 pages.

Yokoyama et al., "Viscous Flow Workability of Ni—Cr—P—B Metallic Glasses Produced by Melt-Spinning in Air," *Materials Transactions*, vol. 48, No. 12, 2007, pp. 3176-3180.

Park T.G. et al., "Development of new Ni—based amorphous alloys containing no metalloid that have large undercooled liquid regions," *Scripta Materialia*, vol. 43, No. 2, 2000, pp. 109-114.

Mitsuhashi A. et al., "The corrosion behavior of amorphous nickel base alloys in a hot concentrated phosphoric acid," *Corrosion Science*, vol. 27, No. 9, 1987, pp. 957-970.

Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.

Abrosimova G. E. et al., "Phase segregation and crystallization in the amorphous alloy $Ni_{70}M0_{10}P_{20}$," *Physics of the Solid State*, vol. 40., No. 9, 1998, pp. 1429-1432.

Yokoyama M. et al., "Hot-press workability of Ni—based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.

Rabinkin et al., "Brazing Stainless Steel Using New MBF—Series of Ni—Cr—B—Si Amorphous Brazing Foils: New Brazing Alloys Withstand High-Temperature and Corrosive Environments," *Welding Research Supplement*, 1998, pp. 66-75.

Chen S.J. et al., "Transient liquid-phase bonding of T91 steel pipes using amorphous foil," *Materials Science and Engineering A*, vol. 499, No. 1-2, 2009, pp. 114-117.

Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.

U.S. Appl. No. 14/191,127, filed Feb. 26, 2014, Na et al.

U.S. Appl. No. 14/501,779, filed Sep. 30, 2014, Na et al.

U.S. Appl. No. 14/824,733, filed Aug. 12, 2015, Na et al.

U.S. Appl. No. 14/797,878, filed Jul. 13, 2015, Na et al.

BULK NICKEL-PHOSPHORUS-BORON GLASSES BEARING MANGANESE, NIOBIUM AND TANTALUM

CROSS-REFERENCE TO RELATED APPLICATIONS

The present application claims the benefit of U.S. Provisional Patent Application No. 61/866,743, entitled "Bulk Nickel-Phosphorus-Boron Glasses Bearing Manganese and Niobium", filed on Aug. 16, 2013, which is incorporated herein by reference in its entirety.

FIELD

The present disclosure relates to Ni—P—B alloys bearing at least one of Nb and Ta and optionally Mn, metallic glasses formed of such alloys, and in some aspects bulk metallic glass rods formed of such alloys with diameters greater than 1 mm and as large as 5 mm or larger.

BACKGROUND

Bulk-glass forming Ni—Nb—P—B alloys bearing Cr capable of forming bulk metallic glass rods with diameters of 3 mm or greater have been disclosed in U.S. patent application Ser. No. 13/592,095, entitled "Bulk Nickel-Based Chromium and Phosphorous Bearing Metallic Glasses", filed on Aug. 22, 2012, and U.S. patent application Ser. No. 14/067,521, entitled "Bulk Nickel-Based Chromium and Phosphorous Bearing Metallic Glasses with High Toughness", filed on Oct. 30, 2013, the disclosures of which are incorporated herein by reference in their entirety.

Bulk-glass forming Ni—Ta—P—B alloys bearing Cr capable of forming bulk metallic glass rods with diameters of 3 mm or greater have been disclosed in U.S. patent application Ser. No. 14/081,622, entitled "Bulk Nickel-Phosphorus-Boron Glasses bearing Chromium and Tantalum", filed on Nov. 15, 2013, the disclosure of which is incorporated herein by reference in its entirety.

Bulk-glass forming Ni—Nb—P—B alloys bearing Mo and optionally Mn capable of forming bulk metallic glass rods with diameters of 3 mm or greater have been disclosed in another recent application: U.S. Patent Application No. 61/847,955, entitled "Bulk Nickel-Phosphorus-Boron Glasses bearing Molybdenum and Niobium", filed on Oct. 8, 2013, the disclosure of which is incorporated herein by reference in its entirety.

These previous Ni—Nb—P—B and Ni—Ta—P—B bulk-glass forming compositions include either Cr or Mo for bulk-glass formation where the atomic concentrations of Cr or Mo are relatively high, extending up to 15% for the Cr-bearing alloys and up to 12% for the Mo-bearing alloys. Such high concentrations of Mo and Cr limit the Ni content to mostly below 70 atomic percent.

BRIEF SUMMARY

The present disclosure is directed to Ni—Nb—P—B and Ni—Ta—P—B alloys that optionally bear Mn that are capable of forming metallic glasses, and more particularly bulk metallic glass rods with diameters greater than 1 mm and as large as 5 mm or larger. The present disclosure is also directed to metallic glasses formed of the alloys. As will be clear to those skilled in the art, In one aspect, the disclosure is directed to an alloy capable of forming a metallic glass represented by the following formula (subscripts denote atomic percent):

$$Ni_{(100-a-b-c-d)}Mn_aX_bP_cB_d \quad (1)$$

where:

a is up to 15 b is between 0.5 and 10 c is between 12 and 21 d is between 1 and 6 wherein X is at least one of Nb and Ta.

In another embodiment, b is at least 1, and the alloy also comprises Mo at atomic concentration of less than 1 percent and/or Cr at atomic concentration of less than 3 percent.

In another embodiment, the sum of c and d is between 18.5 and 20.5.

In another embodiment, the sum of c and d is between 19 and 20.

In another embodiment, up to 1 atomic percent of P is substituted by Si.

In another embodiment, up to 50 atomic percent of Ni is substituted by Co.

In another embodiment, up to 30 atomic percent of Ni is substituted by Fe.

In another embodiment, the alloy comprises Ge, V, Sn, W, Ru, Re, Pd, Pt, or combinations thereof at combined atomic concentration of up to 2 percent.

In another embodiment, the critical rod diameter of the alloy is at least 1 mm.

In another embodiment, the critical rod diameter of the alloy is at least 2 mm.

In another embodiment, the critical rod diameter of the alloy is at least 3 mm.

In yet another embodiment, the melt is fluxed with a reducing agent prior to rapid quenching.

In yet another embodiment, the reducing agent is boron oxide.

In yet another embodiment, the melt prior to quenching is heated to at least 200° C. above the liquidus temperature of the alloy.

In yet another embodiment, the melt prior to quenching is heated to at least 1200° C.

In yet another embodiment, quenching the molten alloy comprises injecting or pouring the molten alloy into a mold.

In yet another embodiment, the notch toughness is at least 60 MPa $m^{1/2}$.

In yet another embodiment, the yield strength is at least 2150 MPa $m^{1/2}$.

In yet another embodiment, a wire made of such metallic glass having a diameter of 1 mm can undergo macroscopic plastic deformation under bending load without fracturing catastrophically.

In another embodiment, the disclosure is directed to an alloy capable of forming a metallic glass, or a metallic glass, comprising an alloy represented by the following formula (subscripts denote atomic percent):

$$Ni_{(100-a-b-c-d)}Mn_aNb_bP_cB_d \quad (2)$$

where:

a is up to 8 b is between 1 and 5 c is between 15 and 18 d is between 1 and 5.

In another embodiment, X is Nb, a is between 0.25 and 5, b is between 1.5 and 4.5, c is between 15.25 to 17.75, and d is between 1.5 and 4.5. In such embodiments, the critical rod diameter of the alloy is at least 1 mm.

In another embodiment, X is Nb, a is between 0.5 and 4.5, b is between 2 and 4, c is between 15.5 to 17.5, and d is between 2 and 4. In such embodiments, the critical rod diameter of the alloy is at least 2 mm.

In another embodiment, X is Nb, a is between 1 and 4, b is between 2 and 4, c is between 16 to 17, and d is between 2.25 and 3.75. In such embodiments, the critical rod diameter of the alloy is at least 3 mm.

In another embodiment, X is Nb, a is between 2.5 and 3.75, b is between 2.5 and 3.5, c is between 16.25 to 16.75, and d is between 2.5 and 3.5. In such embodiments, the critical rod diameter of the alloy is at least 4 mm.

In another embodiment, X is Ta, a is between 3 and 9, b is between 0.5 and 4.5, c is between 15.25 to 17.75, and d is between 1.5 and 4.5. In such embodiments, the critical rod diameter of the alloy is at least 1 mm.

In another embodiment, X is Ta, a is between 4 and 8, b is between 0.5 and 4, c is between 15.5 to 17.5, and d is between 2 and 4. In such embodiments, the critical rod diameter of the alloy is at least 2 mm.

In another embodiment, X is Ta, a is between 4.25 and 7.75, b is between 0.5 and 3.5, c is between 16 to 17, and d is between 2.25 and 3.75. In such embodiments, the critical rod diameter of the alloy is at least 3 mm.

In another embodiment, X is Ta, a is between 4.5 and 7.5, b is between 0.5 and 3.25, c is between 16.25 to 16.75, and d is between 2.5 and 3.5. In such embodiments, the critical rod diameter of the alloy is at least 4 mm.

The disclosure is also directed to an alloy capable of forming a metallic glass selected from $Ni_{77.5}Nb_3P_{16.5}B_3$, $Ni_{77}Mn_{0.5}Nb_3P_{16.5}B_3$, $Ni_{76.5}Mn_1Nb_3P_{16.5}B_3$, $Ni_{76}Mn_{1.5}Nb_3P_{16.5}B_3$, $Ni_{75.5}Mn_2Nb_3P_{16.5}B_3$, $Ni_{75}Mn_{2.5}Nb_3P_{16.5}B_3$, $Ni_{74.5}Mn_3Nb_3P_{16.5}B_3$, $Ni_{74}Mn_{3.5}Nb_3P_{16.5}B_3$, $Ni_{73.5}Mn_4Nb_3P_{16.5}B_3$, $Ni_{73}Mn_{4.5}Nb_3P_{16.5}B_3$, $Ni_{72.5}Mn_5Nb_3P_{16.5}B_3$, $Ni_{74}Mn_3Nb_{3.5}P_{16.5}B_3$, $Ni_{74}Mn_4Nb_{2.5}P_{16.5}B_3$, $Ni_{74.5}Mn_{3.5}Nb_{2.5}P_{16.5}B_3$, $Ni_{73.5}Mn_{3.5}Nb_{3.5}P_{16.5}B_3$, $Ni_{74}Mn_{3.5}Nb_3P_{17}B_{2.5}$, $Ni_{74}Mn_{3.5}Nb_3P_{16}B_{3.5}$, $Ni_{74.46}Mn_{3.52}Nb_{3.02}P_{16.08}B_{2.92}$, $Ni_{73.54}Mn_{3.48}Nb_{2.98}P_{16.92}B_{3.08}$, $Ni_{74}Mn_{6.5}P_{16.5}B_3$, $Ni_{74}Mn_6Ta_{0.5}P_{16.5}B_3$, $Ni_{74}Mn_{5.5}Ta_1P_{16.5}B_3$, $Ni_{74}Mn_5Ta_{1.5}P_{16.5}B_3$, $Ni_{74}Mn_{4.5}Ta_2P_{16.5}B_3$, $Ni_{74}Mn_4Ta_{2.5}P_{16.5}B_3$, $Ni_{74}Mn_{3.5}Ta_3P_{16.5}B_3$, $Ni_{74}Mn_3Ta_{3.5}P_{16.5}B_3$, $Ni_{74}Mn_{2.5}Ta_4P_{16.5}B_3$, $Ni_{75}Mn_4Ta_{1.5}P_{16.5}B_3$, $Ni_{73}Mn_6Ta_{1.5}P_{16.5}B_3$, $Ni_{72}Mn_7Ta_{1.5}P_{16.5}B_3$, $Ni_{71}Mn_8Ta_{1.5}P_{16.5}B_3$, $Ni_{74.5}Mn_6P_{16.5}B_3$, $Ni_{74}Mn_6Ta_{0.5}P_{16.5}B_3$, $Ni_{73.5}Mn_6Ta_1P_{16.5}B_3$, $Ni_{72.5}Mn_6Ta_2P_{16.5}B_3$, $Ni_{72}Mn_6Ta_{2.5}P_{16.5}B_3$ and $Ni_{71.5}Mn_6Ta_3P_{16.5}B_3$.

The disclosure is further directed to a metallic glass according to any of the above formulas and/or formed of any of the foregoing alloys.

Additional embodiments and features are set forth in part in the description that follows, and in part will become apparent to those skilled in the art upon examination of the specification or may be learned by the practice of the embodiments discussed herein. A further understanding of the nature and advantages of certain embodiments may be realized by reference to the remaining portions of the specification and the drawings, which forms a part of this disclosure.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

Figure 1:
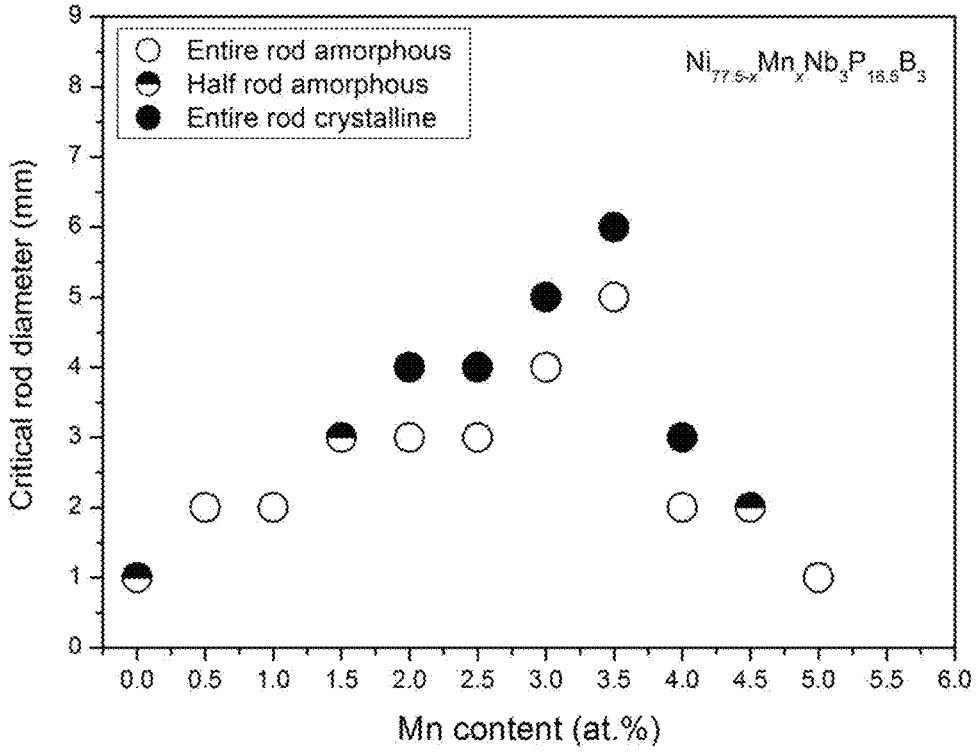
FIG. 1 provides a plot showing the effect of substituting Ni by Mn on the glass forming ability of $Ni_{77.5-x}Mn_xNb_3P_{16.5}B_3$ alloy, in accordance with embodiments of the present disclosure.

The present disclosure is directed to alloys, metallic glasses, and methods of making and using the same. In some aspects, the alloys are described as capable of forming metallic glasses having certain characteristics. It is intended, and will be understood by those skilled in the art, that the disclosure is also directed to metallic glasses formed of the disclosed alloys described herein.

Definitions

In the present disclosure, the term "entirely free" of an element means not more than amounts of the element found in naturally occurring trace amounts.

The glass-forming ability of each alloy can be quantified by the "critical rod diameter", defined as the largest rod diameter in which the amorphous phase (i.e. the metallic glass) can be formed when processed with a method of water quenching a quartz tube with 0.5 mm thick wall containing a molten alloy.

The "notch toughness" is defined as the stress intensity factor at crack initiation $K_q$ when measured on a 3 mm diameter rod containing a notch with length ranging from 1 to 2 mm and root radius ranging from 0.1 to 0.15 mm. Notch toughness is the measure of the material's ability to resist fracture in the presence of a notch. The notch toughness is a measure of the work required to propagate a crack originating from a notch. A high $K_q$ ensures that the material will be tough in the presence of defects.

The "compressive yield strength," $\sigma_y$, is the measure of the material's ability to resist non-elastic yielding. The yield strength is the stress at which the material yields plastically. A high $\sigma_y$ ensures that the material will be strong.

Bending ductility is a measure of the material's ability to deform plastically and resist fracture in bending in the absence of a notch or a pre-crack. A high bending ductility ensures that the material will be ductile in a bending overload.

Description of Metallic Glasses and Alloy Compositions

The toughness of Ni-based metallic glasses bearing P and B may obey a correlation with the Ni content. For example, as shown in U.S. patent application Ser. No. 14/067,521, the notch toughness of P and B bearing Ni-based metallic glasses with Ni content below 70 atomic percent (e.g. samples 8-10 in Table 1) are lower than those with higher Ni content (e.g. samples 1-7 in Table 1). Hence discovering bulk P and B bearing Ni-based glasses having Ni content in excess of 70 atomic percent may enable better combinations of glass forming ability and toughness.

In certain embodiments of the present disclosure, it was found that Ni—P—B alloys containing small fractions of Nb and Ta and optionally Mn and being entirely free of Cr or Mo, demonstrate critical rod diameters comparable to the Ni—Cr—Nb—P—B and Ni—Cr—Ta—P—B alloys. For example, in some embodiments, Ni-based compositions with a Mn content of between 3 and 4 atomic percent, Nb content of about 3 atomic percent, B content of about 3 atomic percent, and P content of about 16.5 atomic percent have critical rod diameters as large as 5 mm or larger. In other embodiments, Ni-based compositions with a Mn content of between 5 and 7 atomic percent, Ta content of between 1 and 2 atomic percent, B content of about 3 atomic percent, and P content of about 16.5 atomic percent have critical rod diameters as large as 5 mm or larger.

It will be understood to those of skill in the art that description of the atomic percent of elements in alloys described herein also describe metallic glasses, as described herein.

Ni—Mn—Nb—P—B alloys

Figure 2:
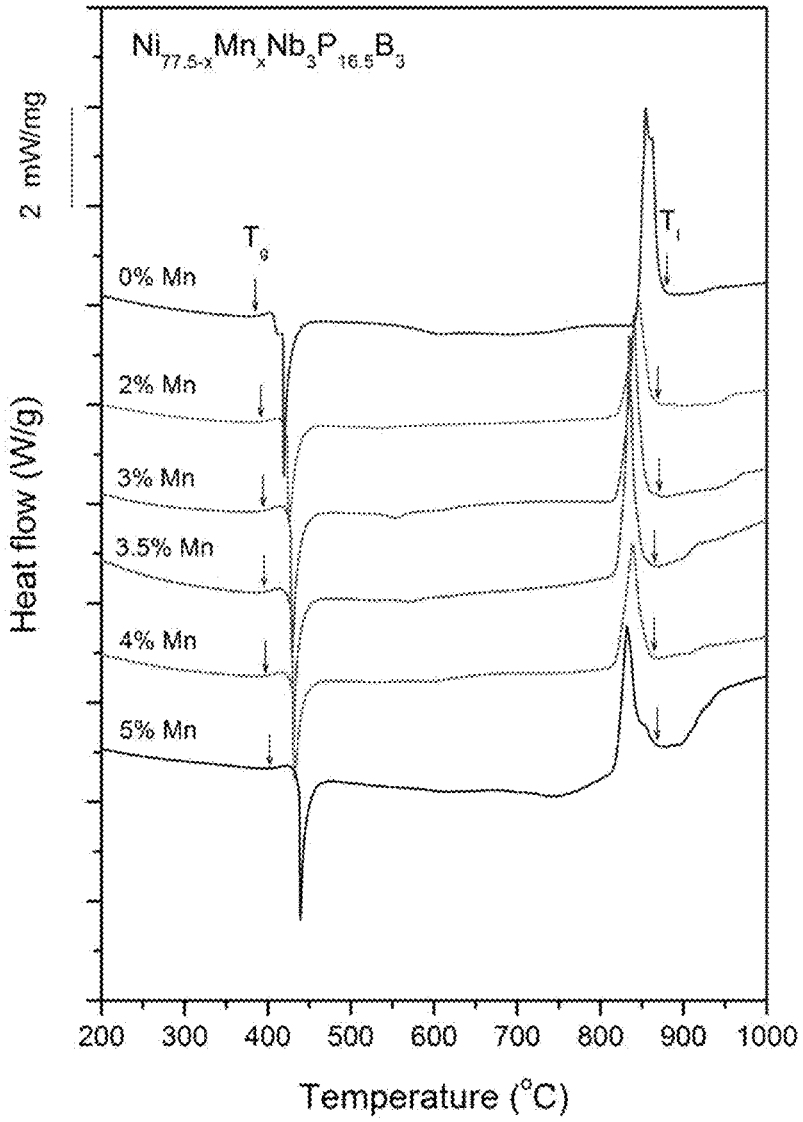
FIG. 2 provides a plot showing calorimetry scans at a heating rate of 20 K/min for sample metallic glasses $Ni_{77.5-x}Mn_xNb_3P_{16.5}B_3$, in accordance with embodiments of the present disclosure. Arrows from left to right designate the glass-transition and liquidus temperatures, respectively.

Sample metallic glasses 1-9 showing the effect of substituting Ni by Mn, according to the formula $Ni_{77.5-x}Mn_xNb_3P_{16.5}B_3$, are presented in Table 1 and FIG. 1. As shown, when the Mn atomic percent is between 0.25 and 5, the critical rod diameter is at least 1 mm, when it is between 0.5 and 4.5 the critical rod diameter is greater than 2 mm. When the Mn atomic percent is between 1 and 4, the critical rod diameter is greater than 3 mm. When the Mn atomic percent is between 2.5 and 3.75, the critical rod diameter is greater than 4 mm. And, when the Mn atomic percent is between 3.25 and 3.75, the critical rod diameter is 5 mm. Differential calorimetry scans for several sample metallic glasses in which Ni is substituted by Mn are presented in FIG. 2.

TABLE 1

Sample metallic glasses demonstrating the effect of increasing the Mn atomic concentration at the expense of Ni on the glass forming ability of Ni—Mn—Nb—P—B alloys

| Sample | Composition | Critical Rod Diameter [mm] |
|---|---|---|
| 1 | $Ni_{77.5}Nb_3P_{16.5}B_3$ | 1 |
| 2 | $Ni_{77}Mn_{0.5}Nb_3P_{16.5}B_3$ | 2 |
| 3 | $Ni_{76.5}Mn_1Nb_3P_{16.5}B_3$ | 2 |
| 4 | $Ni_{76}Mn_{1.5}Nb_3P_{16.5}B_3$ | 3 |
| 5 | $Ni_{75.5}Mn_2Nb_3P_{16.5}B_3$ | 3 |
| 6 | $Ni_{75}Mn_{2.5}Nb_3P_{16.5}B_3$ | 3 |
| 7 | $Ni_{74.5}Mn_3Nb_3P_{16.5}B_3$ | 4 |
| 8 | $Ni_{74}Mn_{3.5}Nb_3P_{16.5}B_3$ | 5 |
| 9 | $Ni_{73.5}Mn_4Nb_3P_{16.5}B_3$ | 2 |

TABLE 1-continued

Sample metallic glasses demonstrating the effect of increasing the Mn atomic concentration at the expense of Ni on the glass forming ability of Ni—Mn—Nb—P—B alloys

| Sample | Composition | Critical Rod Diameter [mm] |
|---|---|---|
| 10 | $Ni_{73}Mn_{4.5}Nb_3P_{16.5}B_3$ | 2 |
| 11 | $Ni_{72.5}Mn_5Nb_3P_{16.5}B_3$ | 1 |

Figure 3:
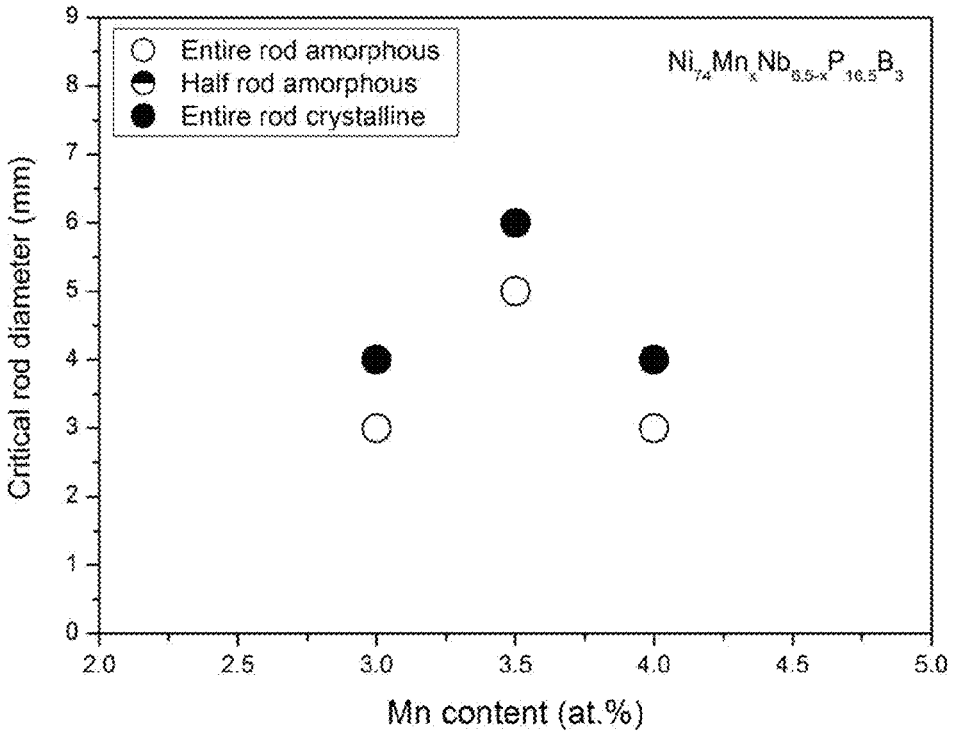
FIG. 3 provides a plot showing the effect of substituting Nb by Mn on the glass forming ability of $Ni_{74}Mn_xNb_{6.5-x}P_{16.5}B_3$ alloys, in accordance with embodiments of the present disclosure.
Figure 4:
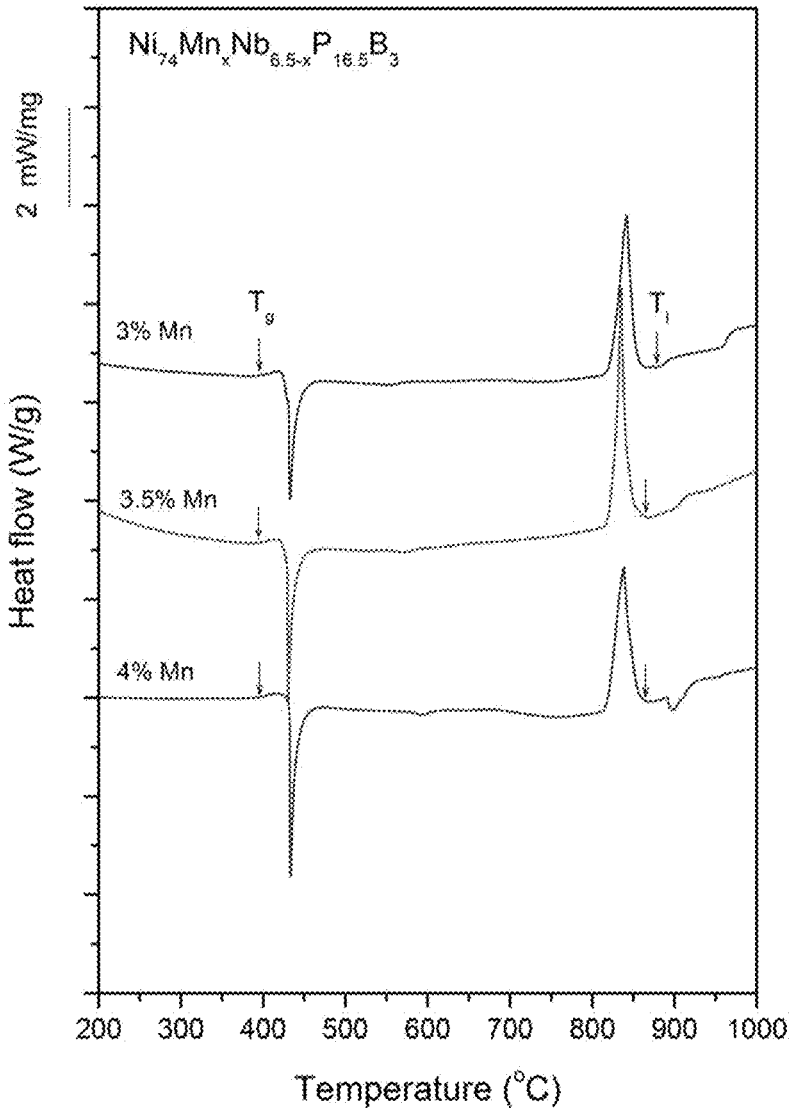
FIG. 4 provides a plot showing calorimetry scans at a heating rate of 20 K/min for sample metallic glasses $Ni_{74}Mn_xNb_{6.5-x}P_{16.5}B_3$, in accordance with embodiments of the present disclosure. Arrows from left to right designate the glass-transition and liquidus temperatures, respectively.

Sample metallic glasses 8, 12 and 13 showing the effect of substituting Nb by Mn, according to the formula $Ni_{74}Mn_xNb_{6.5-x}P_{16.5}B_3$, are presented in Table 2 and FIG. 3. As shown, when the Mn atomic percent is between 3 and 4, the critical rod diameter is at least 3 mm, while when the Mn atomic percent is between 3.25 and 3.75, the critical rod diameter is at least 4, and in some embodiments at least 5 mm. Differential calorimetry scans for several sample metallic glasses in which Nb is substituted by Mn are presented in FIG. 4.

TABLE 2

Sample metallic glasses demonstrating the effect of increasing the Mn atomic concentration at the expense of Nb on the glass forming ability of Ni—Mn—Nb—P—B alloys

| Sample | Composition | Critical Rod Diameter [mm] |
|---|---|---|
| 12 | $Ni_{74}Mn_3Nb_{3.5}P_{16.5}B_3$ | 3 |
| 8 | $Ni_{74}Mn_{3.5}Nb_3P_{16.5}B_3$ | 5 |
| 13 | $Ni_{74}Mn_4Nb_{2.5}P_{16.5}B_3$ | 3 |

Figure 5:
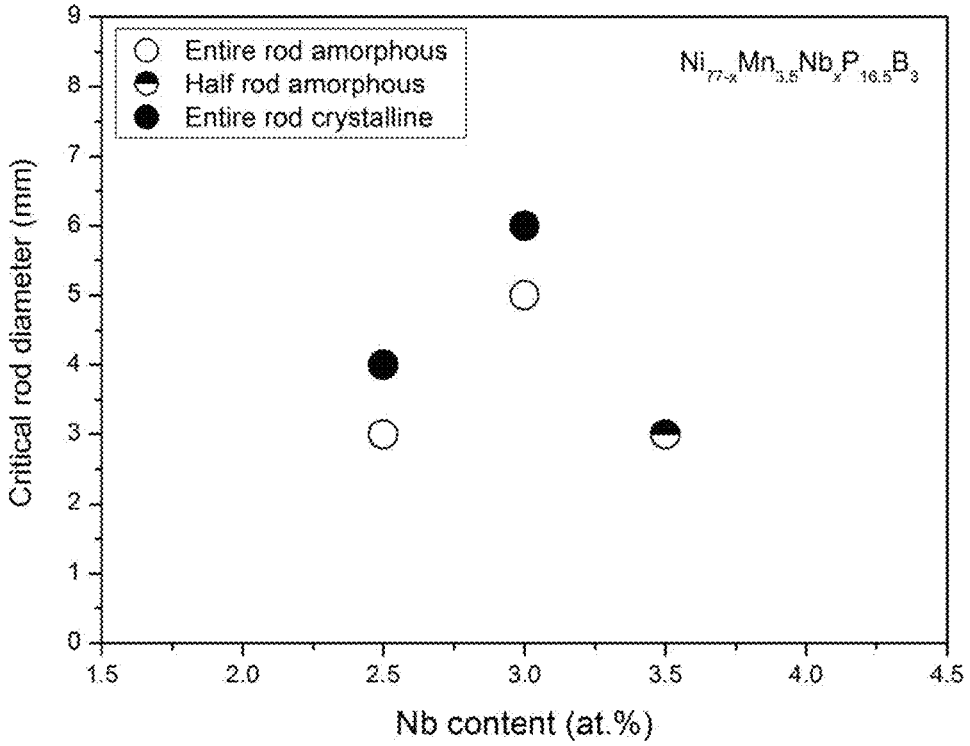
FIG. 5 provides a plot showing the effect of substituting Ni by Nb on the glass forming ability of $Ni_{77-x}Mn_{3.5}Nb_xP_{16.5}B_3$ alloys, in accordance with embodiments of the present disclosure.
Figure 6:
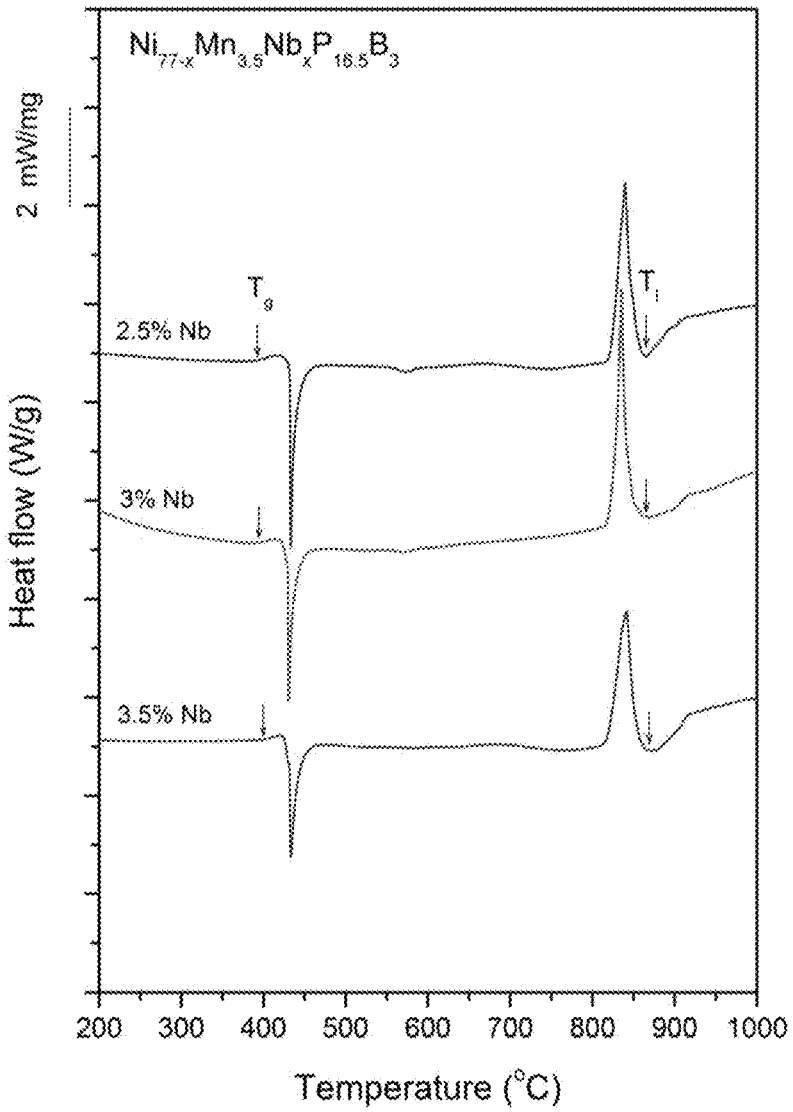
FIG. 6 provides a plot showing calorimetry scans at a heating rate of 20 K/min for sample metallic glasses $Ni_{77-x}Mn_{3.5}Nb_xP_{16.5}B_3$, in accordance with embodiments of the present disclosure. Arrows from left to right designate the glass-transition and liquidus temperatures, respectively.

Sample metallic glasses 8, 14 and 15 showing the effect of substituting Ni by Nb, according to the formula $Ni_{77-x}Mn_{3.5}Nb_xP_{16.5}B_3$, are presented in Table 3 and FIG. 5. As shown, when the Nb atomic percent is between 2.5 and 3.5, the critical rod diameter is at least 3 mm, while when the Nb atomic percent is between 2.75 and 3.25, the critical rod diameter is at least 4 mm, and in some embodiments at least 5 mm. Differential calorimetry scans for several sample metallic glasses in which Ni is substituted by Nb are presented in FIG. 6.

TABLE 3

Sample metallic glasses demonstrating the effect of increasing the Nb atomic concentration at the expense of Ni on the glass forming ability of Ni—Mn—Nb—P—B alloys

| Sample | Composition | Critical Rod Diameter [mm] |
|---|---|---|
| 14 | $Ni_{74.5}Mn_{3.5}Nb_{2.5}P_{16.5}B_3$ | 3 |
| 8 | $Ni_{74}Mn_{3.5}Nb_3P_{16.5}B_3$ | 5 |
| 15 | $Ni_{73.5}Mn_{3.5}Nb_{3.5}P_{16.5}B_3$ | 3 |

Figure 7:
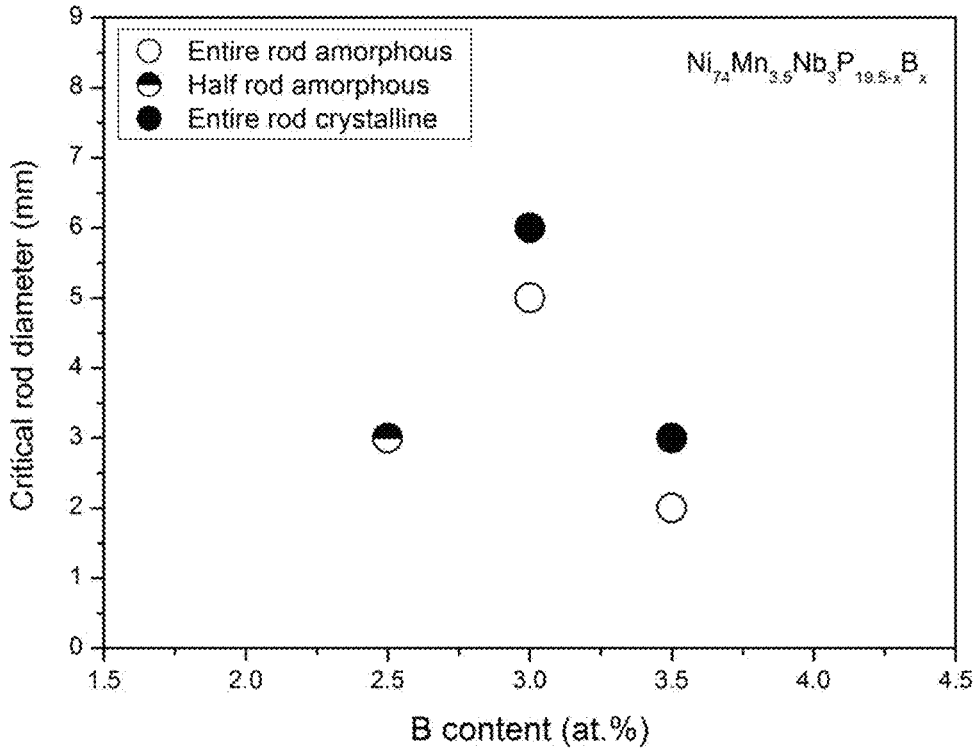
FIG. 7 provides a plot showing the effect of substituting P by B on the glass forming ability of $Ni_{74}Mn_{3.5}Nb_3P_{19.5-x}B_x$ alloys, in accordance with embodiments of the present disclosure.
Figure 8:
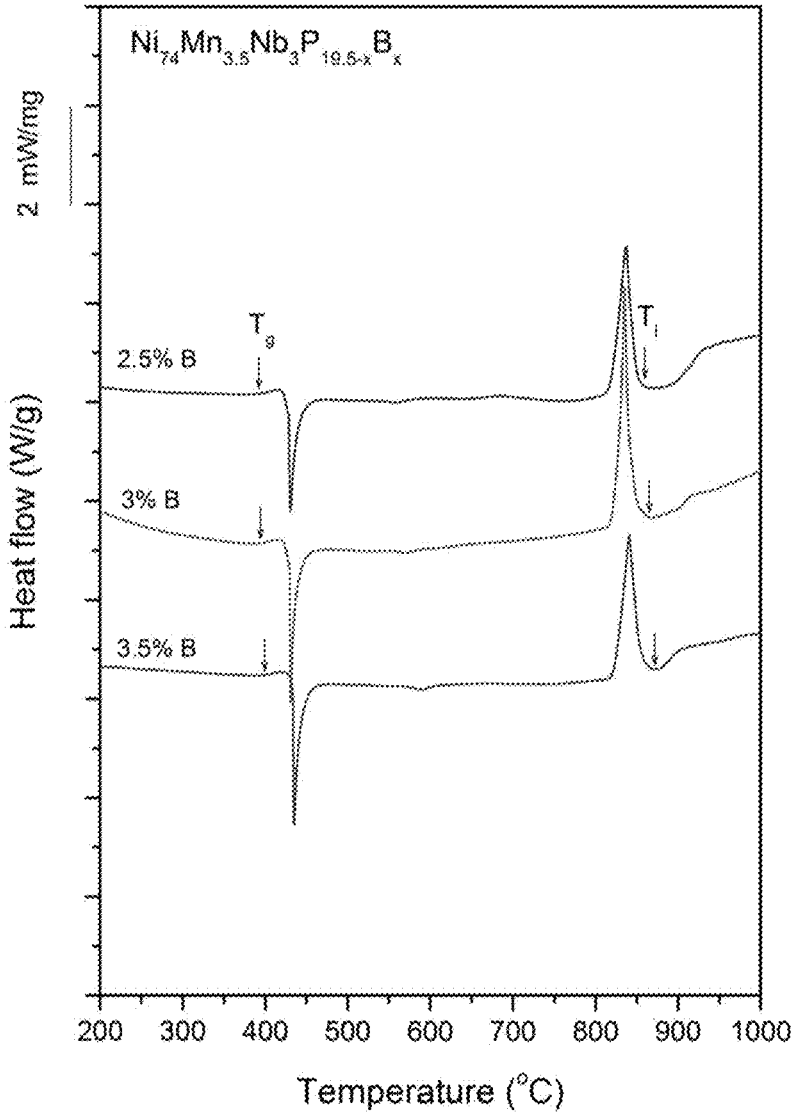
FIG. 8 provides a plot showing calorimetry scans at a heating rate of 20 K/min for sample metallic glasses $Ni_{74}Mn_{3.5}Nb_3P_{19.5-x}B_x$, in accordance with embodiments of the present disclosure. Arrows from left to right designate the glass-transition and liquidus temperatures, respectively.

Sample metallic glasses 8, 16 and 17 showing the effect of substituting P by B, according to the formula $Ni_{74}Mn_{3.5}Nb_3P_{19.5-x}B_x$, are presented in Table 4 and FIG. 7. As shown, when the B atomic percent is between 2.5 and 3.5, the critical rod diameter is at least 2 mm, while when the B atomic percent is between 2.75 and 3.25, the critical rod diameter is at least 4 mm, and in some embodiments at least 5 mm. Differential calorimetry scans for several sample metallic glasses in which P is substituted by B are presented in FIG. 8.

TABLE 4

Sample metallic glasses demonstrating the effect of increasing the B atomic concentration at the expense of P on the glass forming ability of Ni—Mn—Nb—P—B alloys

| Sample | Composition | Critical Rod Diameter [mm] |
|---|---|---|
| 16 | $Ni_{74}Mn_{3.5}Nb_3P_{17}B_{2.5}$ | 3 |
| 8 | $Ni_{74}Mn_{3.5}Nb_3P_{16.5}B_3$ | 5 |
| 17 | $Ni_{74}Mn_{3.5}Nb_3P_{16}B_{3.5}$ | 2 |

Figure 9:
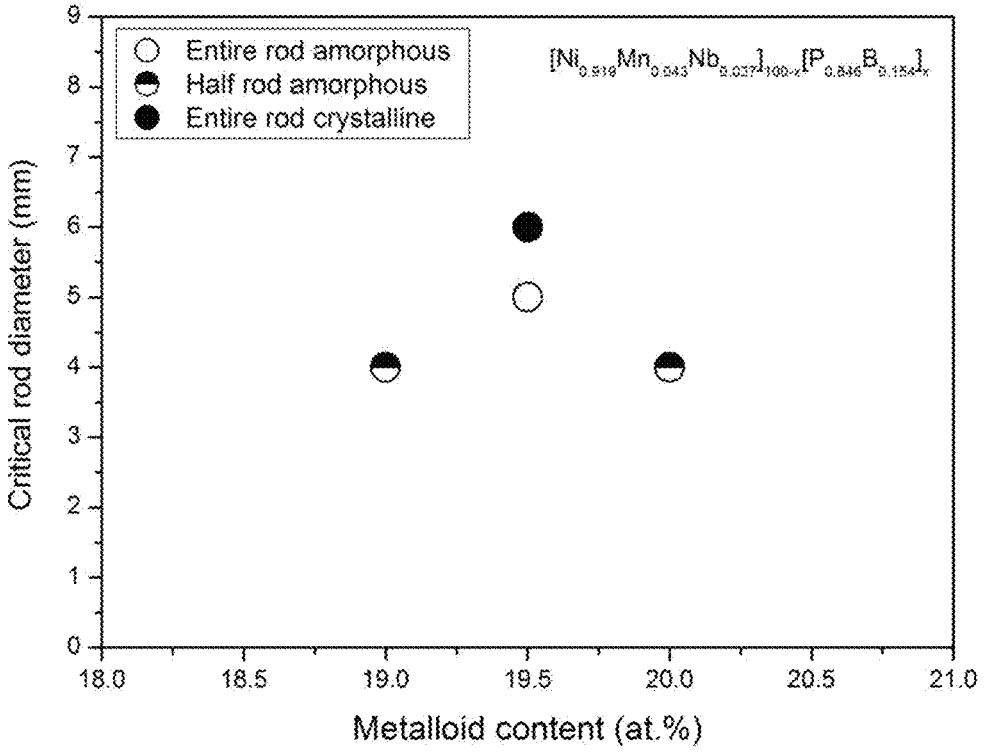
FIG. 9 provides a plot showing the effect of varying the metal to metalloid ratio, according to the formula $(Ni_{0.919}Mn_{0.043}Nb_{0.037})_{100-x}(P_{0.846}B_{0.154})_x$, in accordance with embodiments of the present disclosure.
Figure 10:
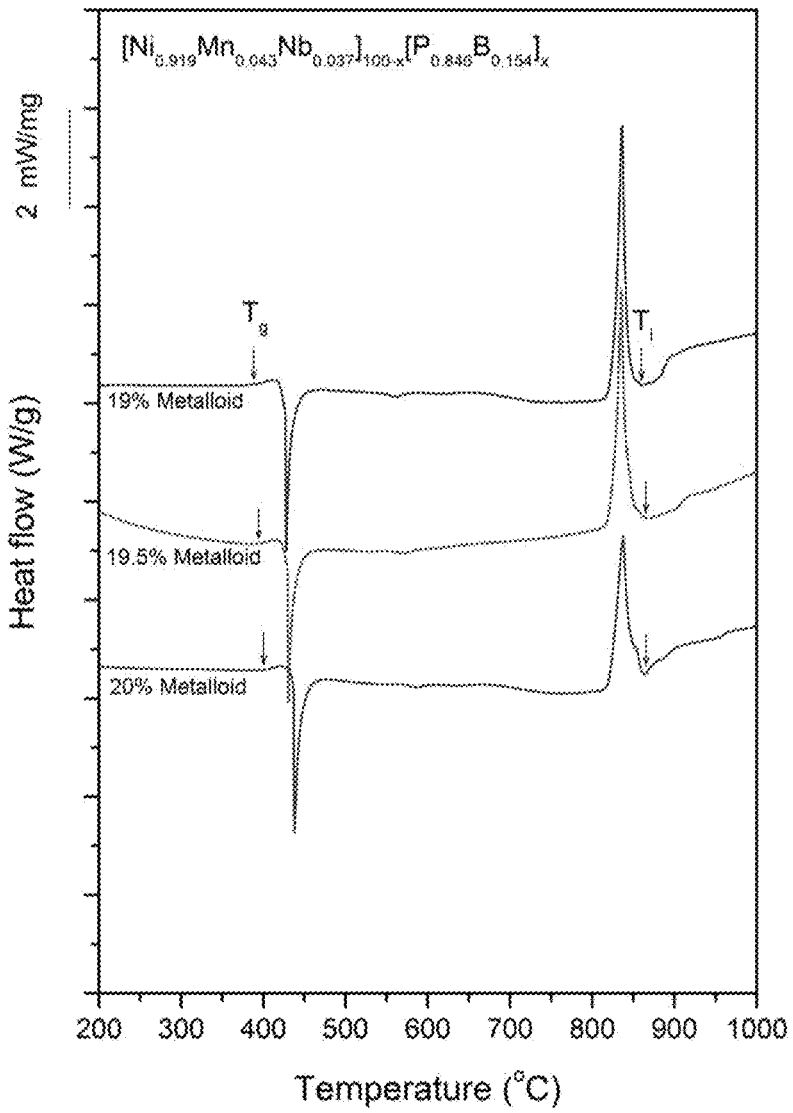
FIG. 10 provides a plot showing calorimetry scans at a heating rate of 20 K/min for sample metallic glasses $(Ni_{0.919}Mn_{0.043}Nb_{0.037})_{100-x}(P_{0.846}B_{0.154})_x$, in accordance with embodiments of the present disclosure. Arrows from left to right designate the glass-transition and liquidus temperatures, respectively.

Sample metallic glasses showing the effect of varying the metal to metalloid ratio, according to the formula $(Ni_{0.919}Mn_{0.043}Nb_{0.037})_{100-x}(P_{0.846}B_{0.154})_x$, are presented in Table 5 and FIG. 9. As shown, when the metalloid atomic percent x is between 19 and 20, the critical rod diameter is at least 4 mm, while when the metalloid atomic percent is between 19.5 and 19.75, the critical rod diameter is at least 4 mm, and in some embodiments, at least 5 mm. Differential calorimetry scans for example metallic glasses in which the metal to metalloid ratio is varied are presented in FIG. 10.

TABLE 5

Sample metallic glasses demonstrating the effect of increasing the total metalloid concentration at the expense of metals on the glass forming ability of Ni—Mn—Nb—P—B alloys

| Sample | Composition | Critical Rod Diameter [mm] |
|---|---|---|
| 18 | $Ni_{74.46}Mn_{3.52}Nb_{3.02}P_{16.08}B_{2.92}$ | 4 |
| 8 | $Ni_{74}Mn_{3.5}Nb_3P_{16.5}B_3$ | 5 |
| 19 | $Ni_{73.54}Mn_{3.48}Nb_{2.98}P_{16.92}B_{3.08}$ | 4 |

Most sample metallic glasses in Tables 1-5 have nickel composition equal to or higher than 73.5 atomic percent, which is higher than the nickel composition in almost all the P and B Ni-based metallic glasses disclosed in the earlier disclosures (e.g., U.S. patent application Ser. No. 13/592,095 and U.S. patent application Ser. No. 14/067,521). The higher nickel concentration may enable a higher toughness.

Among the alloy compositions investigated in this disclosure, the alloy exhibiting the highest glass-forming ability is Example 8, having composition $Ni_{74}Mn_{3.5}Nb_3P_{16.5}B_3$, which demonstrates a critical rod diameter of 5 mm. The measured notch toughness and yield strength of sample metallic glass $Ni_{74}Mn_{3.5}Nb_3P_{16.5}B_3$ are listed along with the critical rod diameter in Table 6. Example 8 provides a good combination of high toughness, high strength, and good glass forming ability. The notch toughness of the metallic glasses according to the disclosure is expected to be at least 60 MPa $m^{1/2}$, and the yield strength at least 2150 MPa $m^{1/2}$.

Figure 11:
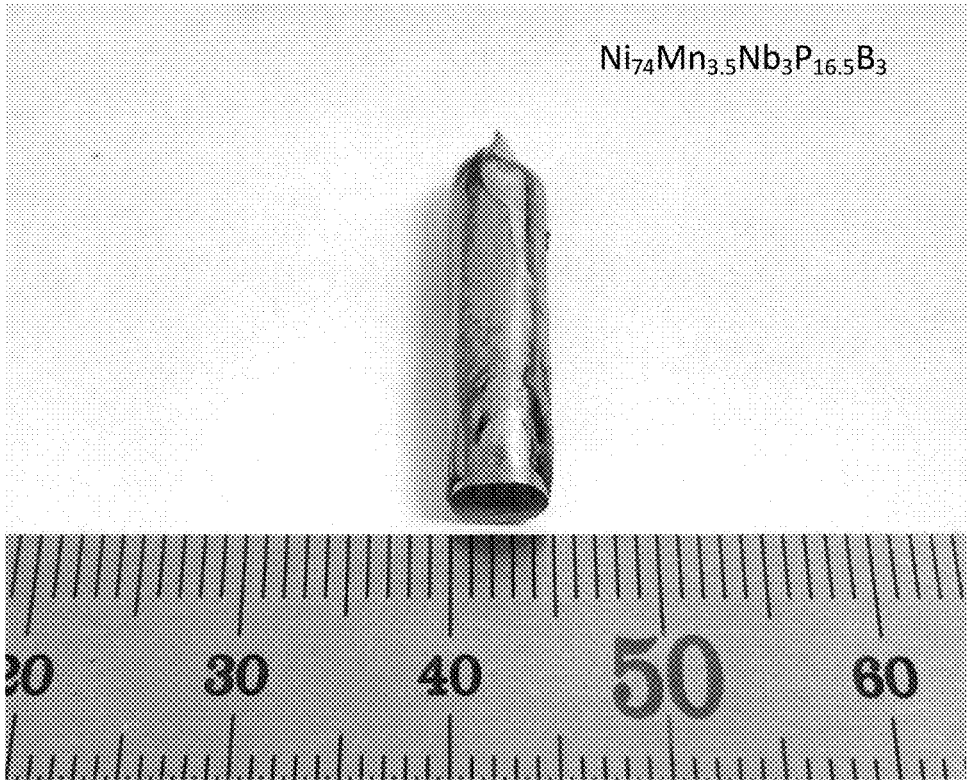
FIG. 11 provides an image of an amorphous 5 mm rod of sample metallic glass $Ni_{74}Mn_{3.5}Nb_3P_{16.5}B_3$, in accordance with an embodiment of the present disclosure.
Figure 12:
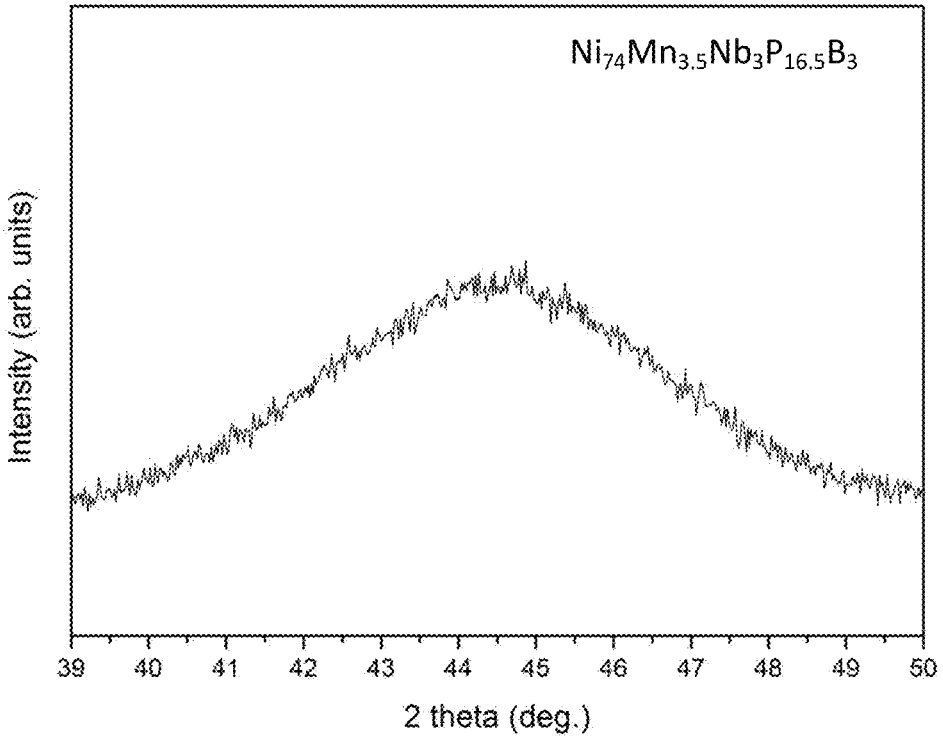
FIG. 12 provides an x-ray diffractogram verifying the amorphous structure of a 5 mm rod of sample metallic glass $Ni_{74}Mn_{3.5}Nb_3P_{16.5}B_3$, in accordance with an embodiment an the present disclosure.
Figure 13:
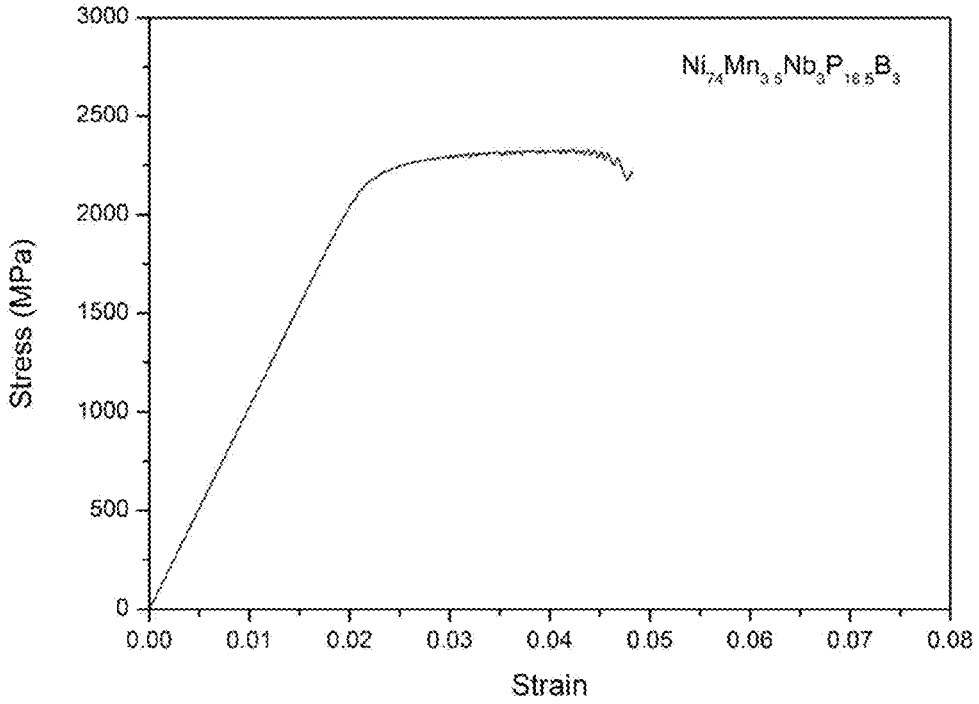
FIG. 13 provides a compressive stress-strain diagram for sample metallic glass $Ni_{74}Mn_{3.5}Nb_3P_{16.5}B_3$, in accordance with an embodiment of the present disclosure.

An image of a 5 mm diameter amorphous $Ni_{74}Mn_{3.5}Nb_3P_{16.5}B_3$ rod is shown in FIG. 11. An x-ray diffractogram taken on the cross section of a 5 mm diameter $Ni_{74}Mn_{3.5}Nb_3P_{16.5}B_3$ rod verifying its amorphous structure is shown in FIG. 12. The stress-strain diagram for sample metallic glass $Ni_{74}Mn_{3.5}Nb_3P_{16.5}B_3$ is presented in FIG. 13.

TABLE 6

Critical rod diameter, notch toughness, and yield strength of $Ni_{74}Mn_{3.5}Nb_3P_{16.5}B_3$ metallic glass.

| Sample | Composition | Critical Rod Diameter [mm] | Notch Toughness [MPa $m^{1/2}$] | Yield Strength [MPa] |
|---|---|---|---|---|
| 8 | $Ni_{74}Mn_{3.5}Nb_3P_{16.5}B_3$ | 5 | 84.3 ± 3.8 | 2220 |

Ni—Mn—Ta—P—B alloys

Figure 14:
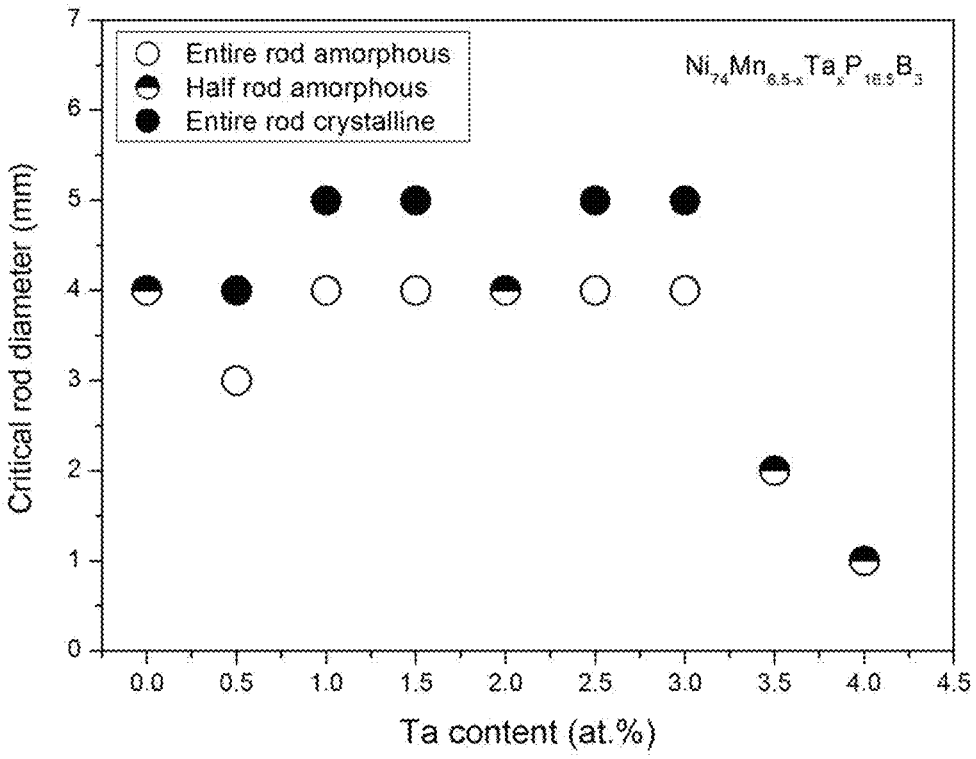
FIG. 14 provides a plot showing the effect of substituting Mn by Ta on the glass forming ability of $Ni_{74}Mn_{6.5-x}Ta_xP_{16.5}B_3$ alloy, in accordance with embodiments of the present disclosure.
Figure 15:
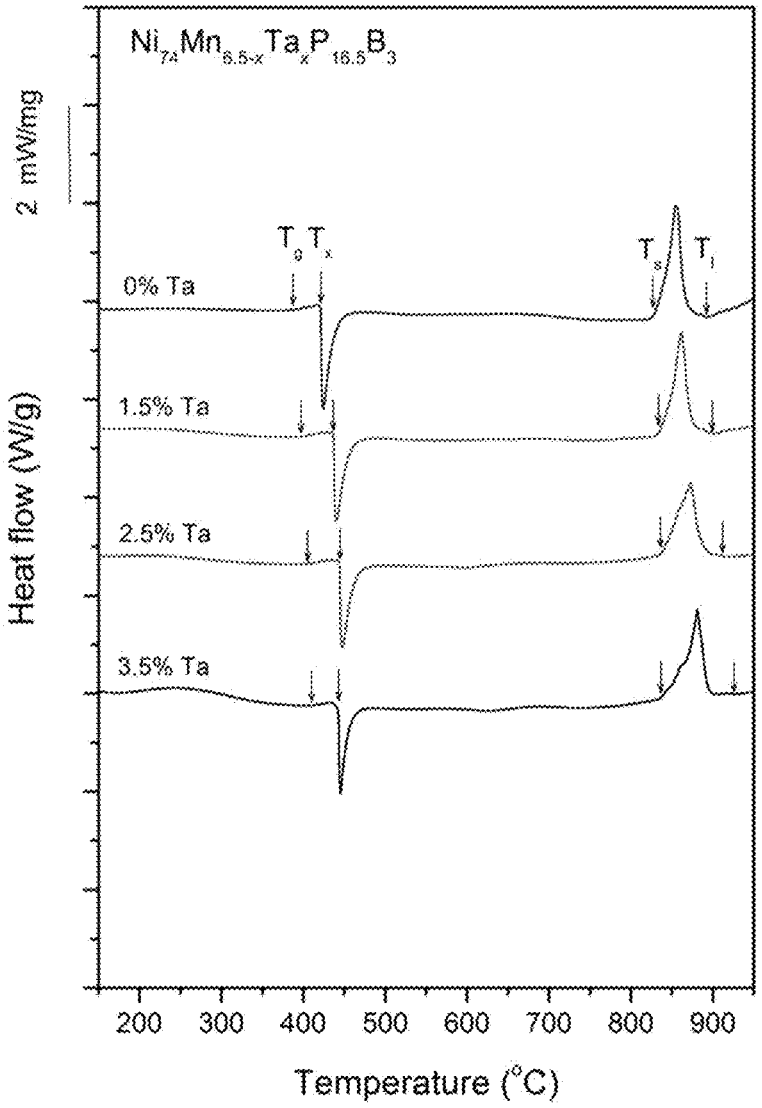
FIG. 15 provides a plot showing calorimetry scans at a heating rate of 20 K/min for sample metallic glasses $Ni_{74}Mn_{6.5-x}Ta_xP_{16.5}B_3$, in accordance with embodiments of the present disclosure. Arrows from left to right designate the glass-transition and liquidus temperatures, respectively.

Sample metallic glasses showing the effect of substituting Mn by Ta, according to the formula $Ni_{74}Mn_{6.5-x}Ta_xP_{16.5}B_3$, are presented in Table 7 and FIG. 14. As shown, when the Ta atomic percent is between 0.5 and 4, the critical rod diameter is at least 1 mm, when it is between 0.5 and 3.5 the critical rod diameter is at least 2 mm, when it is between 0.5 and 3.25 the critical rod diameter is at least 3 mm, while when it is between 1 and 3 the critical rod diameter is at least 4 mm. Differential calorimetry scans for example metallic glasses in which Mn is substituted by Ta are presented in FIG. 15.

TABLE 7

Sample metallic glasses demonstrating the effect of increasing the Ta atomic concentration at the expense of Mn on the glass forming ability of the Ni—Mn—Ta—P—B alloy

| Example | Composition | Critical Rod Diameter [mm] |
|---|---|---|
| 20 | $Ni_{74}Mn_{6.5}P_{16.5}B_3$ | 4 |
| 21 | $Ni_{74}Mn_6Ta_{0.5}P_{16.5}B_3$ | 3 |
| 22 | $Ni_{74}Mn_{5.5}Ta_1P_{16.5}B_3$ | 4 |
| 23 | $Ni_{74}Mn_5Ta_{1.5}P_{16.5}B_3$ | 4 |
| 24 | $Ni_{74}Mn_{4.5}Ta_2P_{16.5}B_3$ | 4 |
| 25 | $Ni_{74}Mn_4Ta_{2.5}P_{16.5}B_3$ | 4 |
| 26 | $Ni_{74}Mn_{3.5}Ta_3P_{16.5}B_3$ | 4 |
| 27 | $Ni_{74}Mn_3Ta_{3.5}P_{16.5}B_3$ | 2 |
| 28 | $Ni_{74}Mn_{2.5}Ta_4P_{16.5}B_3$ | 1 |

Figure 16:
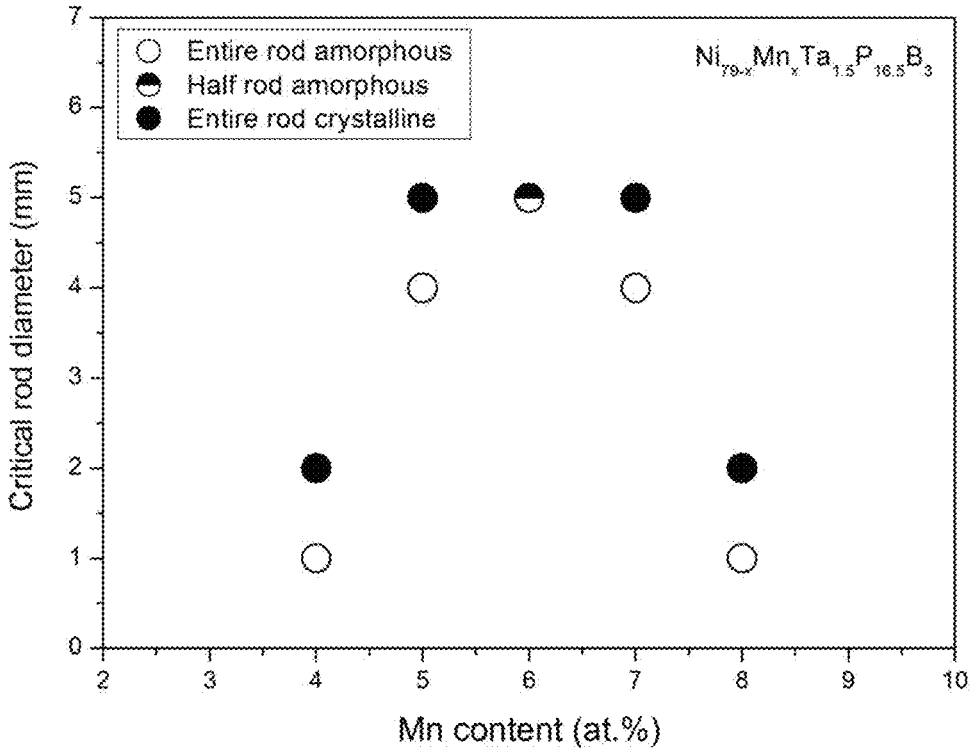
FIG. 16 provides a plot showing the effect of substituting Ni by Mn on the glass forming ability of $Ni_{79-x}Mn_xTa_{1.5}P_{16.5}B_3$ alloys, in accordance with embodiments of the present disclosure.
Figure 17:
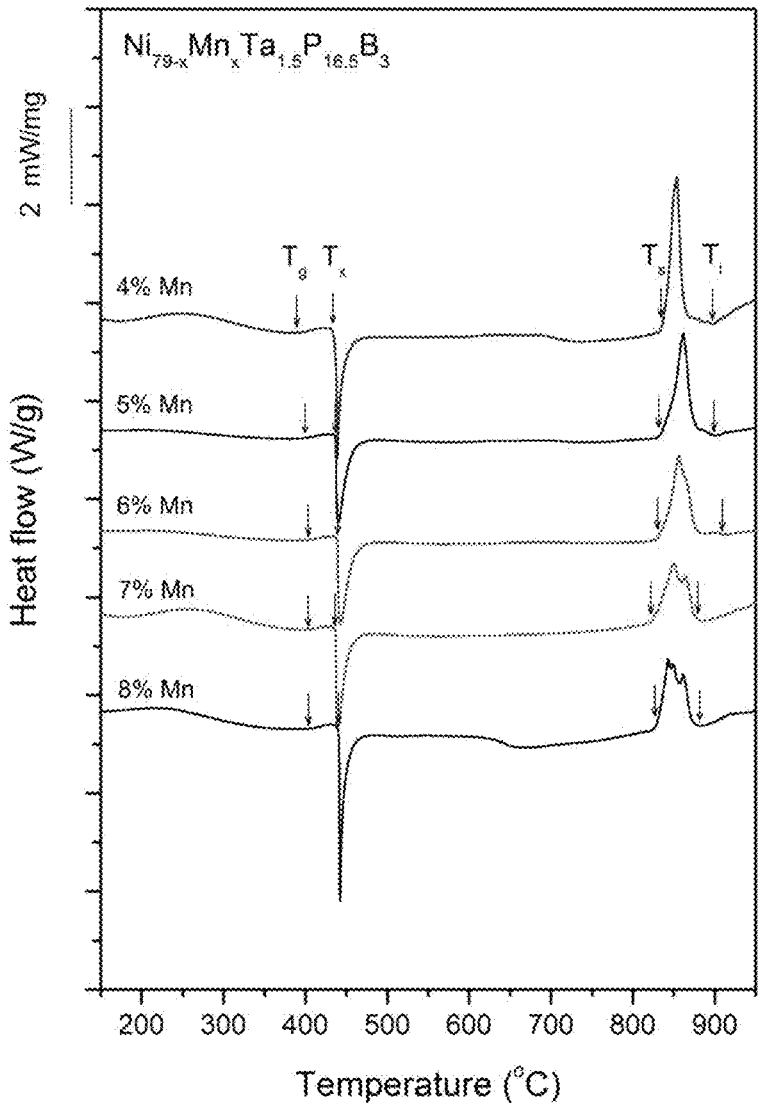
FIG. 17 provides a plot showing calorimetry scans at a heating rate of 20 K/min for sample metallic glasses $Ni_{79-x}Mn_xTa_{1.5}P_{16.5}B_3$, in accordance with embodiments of the present disclosure. Arrows from left to right designate the glass-transition and liquidus temperatures, respectively.

Sample metallic glasses showing the effect of substituting Ni by Mn, according to the formula $Ni_{79-x}Mn_xTa_{1.5}P_{16.5}B_3$, are presented in Table 8 and FIG. 16. As shown, when the Mn atomic percent is between 3.5 and 8.5, the critical rod diameter is at least 1 mm, when it is between 4.5 and 7.5 the critical rod diameter is at least 4 mm, while when the Mn atomic percent is between 5.25 and 6.75, the critical rod diameter is at least 4 mm, and in some embodiments at least 5 mm. Differential calorimetry scans for example metallic glasses in which Ni is substituted by Mn are presented in FIG. 17.

TABLE 8

Sample metallic glasses demonstrating the effect of increasing the Mn atomic concentration at the expense of Ni on the glass forming ability of the Ni—Mn—Ta—P—B alloy

| Example | Composition | Critical Rod Diameter [mm] |
|---|---|---|
| 29 | $Ni_{75}Mn_4Ta_{1.5}P_{16.5}B_3$ | 1 |
| 23 | $Ni_{74}Mn_5Ta_{1.5}P_{16.5}B_3$ | 4 |
| 30 | $Ni_{73}Mn_6Ta_{1.5}P_{16.5}B_3$ | 5 |
| 31 | $Ni_{72}Mn_7Ta_{1.5}P_{16.5}B_3$ | 4 |
| 32 | $Ni_{71}Mn_8Ta_{1.5}P_{16.5}B_3$ | 1 |

Figure 18:
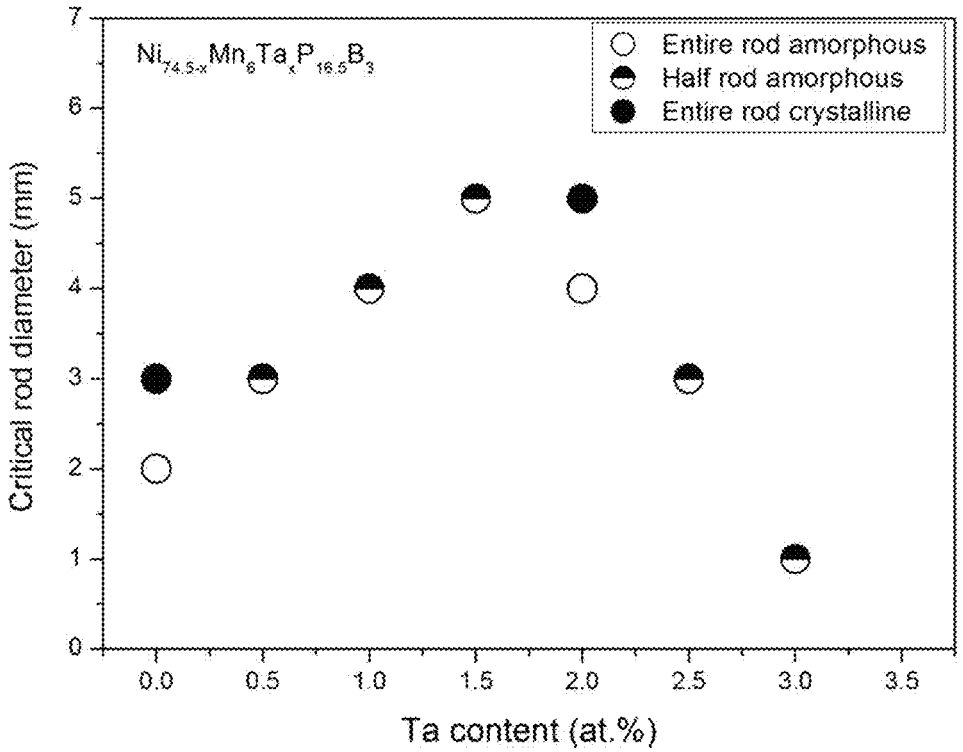
FIG. 18 provides a plot showing the effect of substituting Ni by Mn on the glass forming ability of $Ni_{74.5-x}Mn_6Ta_xP_{16.5}B_3$ alloys, in accordance with embodiments of the present disclosure.
Figure 19:
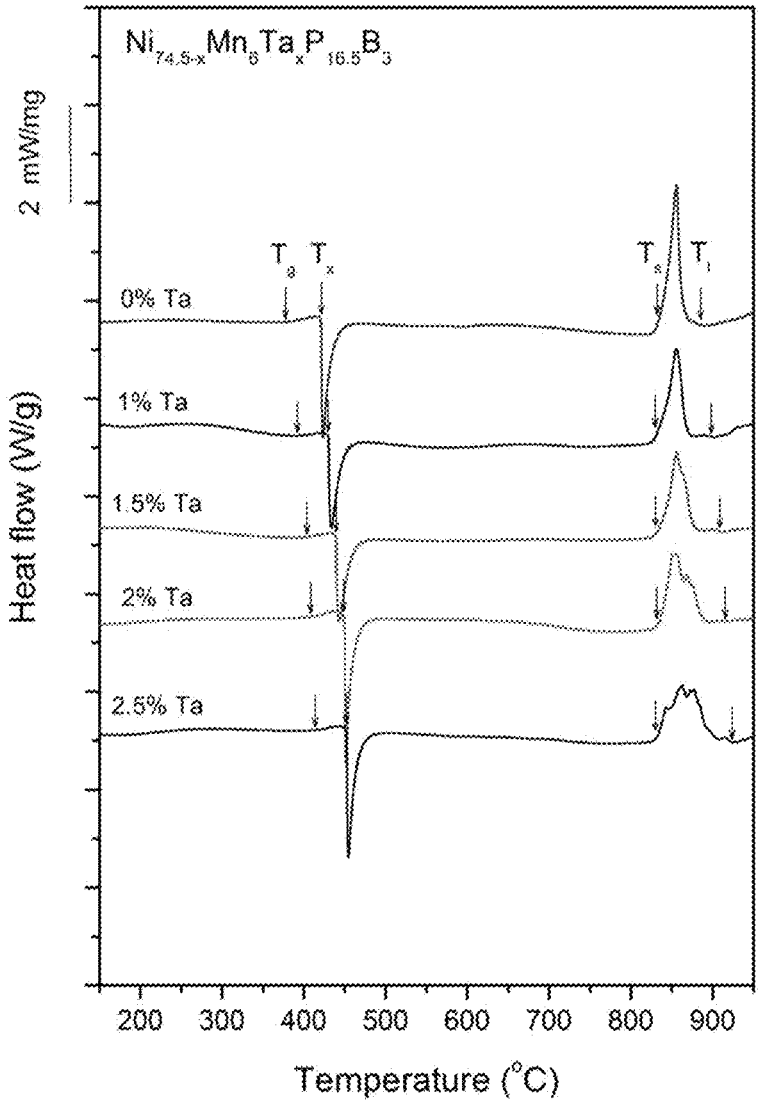
FIG. 19 provides a plot showing calorimetry scans at a heating rate of 20 K/min for sample metallic glasses $Ni_{74.5-x}Mn_6Ta_xP_{16.5}B_3$, in accordance with embodiments of the present disclosure. Arrows from left to right designate the glass-transition and liquidus temperatures, respectively.

Sample metallic glasses showing the effect of substituting Ni by Ta, according to the formula $Ni_{74.5-x}Mn_6Ta_xP_{16.5}B_3$, are presented in Table 9 and FIG. 18. As shown, when the Ta atomic percent is between 0.5 and 3, the critical rod diameter is at least 1 mm, when it is between 0.5 and 2.5 the critical rod diameter is at least 3 mm, when it is between 1 and 2.25 the critical rod diameter is at least 4 mm, while when it is between 1.25 and 2 the critical rod diameter is at least 4 mm, and in some embodiments at least 5 mm. Differential calorimetry scans for example metallic glasses in which Ni is substituted by Ta are presented in FIG. 19.

TABLE 9

Sample metallic glasses demonstrating the effect of increasing the Ta atomic concentration at the expense of Ni on the glass forming ability of the Ni—Mn—Ta—P—B alloy

| Example | Composition | Critical Rod Diameter [mm] |
|---|---|---|
| 33 | $Ni_{74.5}Mn_6P_{16.5}B_3$ | 2 |
| 34 | $Ni_{74}Mn_6Ta_{0.5}P_{16.5}B_3$ | 3 |
| 35 | $Ni_{73.5}Mn_6Ta_1P_{16.5}B_3$ | 4 |
| 30 | $Ni_{73}Mn_6Ta_{1.5}P_{16.5}B_3$ | 5 |
| 36 | $Ni_{72.5}Mn_6Ta_2P_{16.5}B_3$ | 4 |
| 37 | $Ni_{72}Mn_6Ta_{2.5}P_{16.5}B_3$ | 3 |
| 38 | $Ni_{71.5}Mn_6Ta_3P_{16.5}B_3$ | 1 |

Many sample metallic glasses in Tables 7-9 have nickel compositions equal to or higher than 73.5 atomic percent, which is higher than the nickel composition in almost all the P and B Ni-based metallic glasses disclosed in the earlier disclosures (e.g., U.S. patent application Ser. No. 13/592,095 and U.S. patent application Ser. No. 14/067,521). The higher nickel concentration may enable a higher toughness.

Among the alloy compositions investigated in this disclosure, the alloy exhibiting the highest glass-forming ability is Example 30, having composition $Ni_{73}Mn_6Ta_{1.5}P_{16.5}B_3$, which demonstrates a critical rod diameter of 5 mm. The measured notch toughness and yield strength of sample metallic glass $Ni_{73}Mn_6Ta_{1.5}P_{16.5}B_3$ are listed along with the critical rod diameter in Table 10. Example 30 provides a good combination of high toughness and good glass forming ability.

Figure 20:
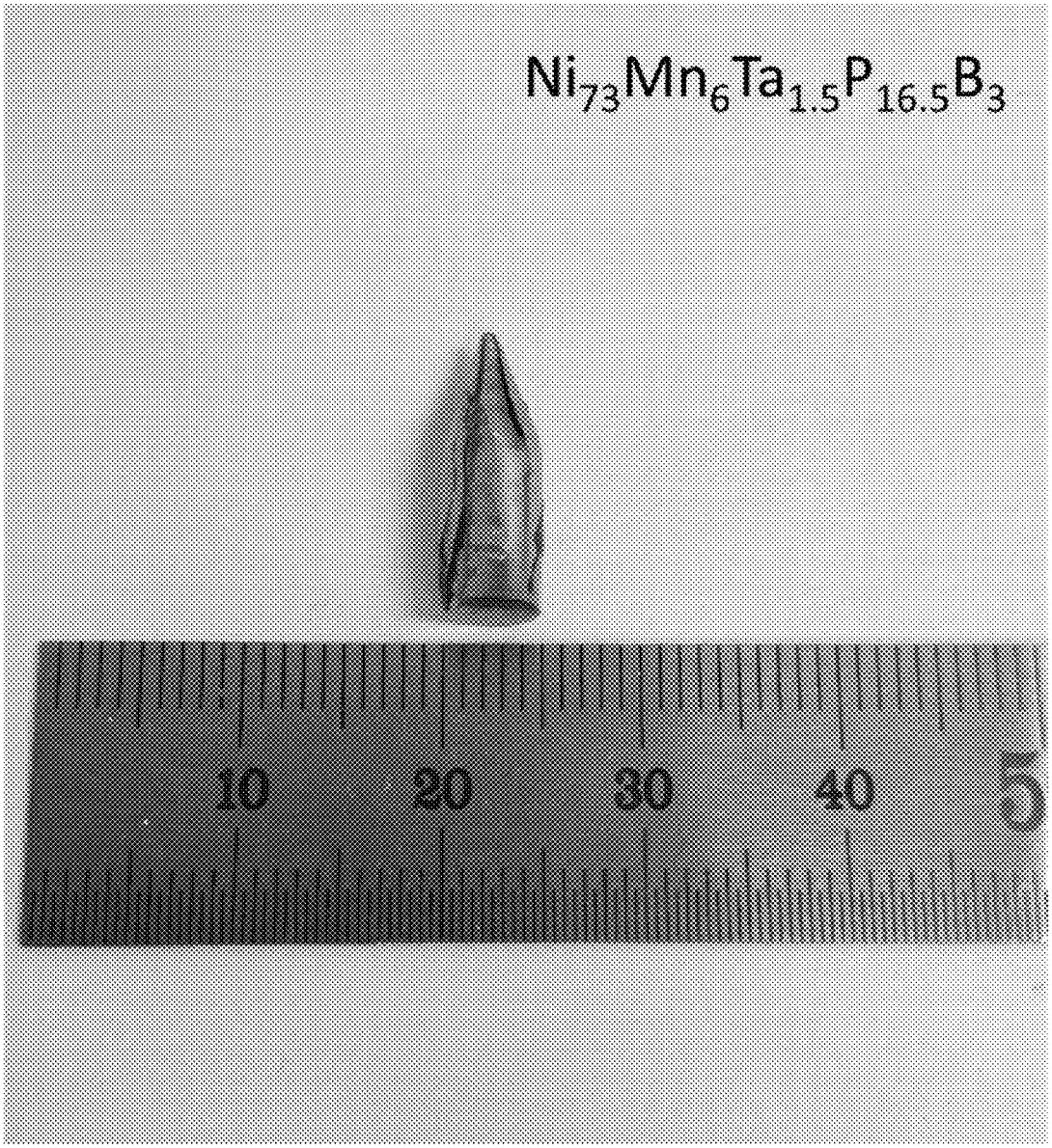
FIG. 20 provides an image of an amorphous 5 mm rod of sample metallic glass $Ni_{73}Mn_6Ta_{1.5}P_{16.5}B_3$, in accordance with an embodiment of the present disclosure.
Figure 21:
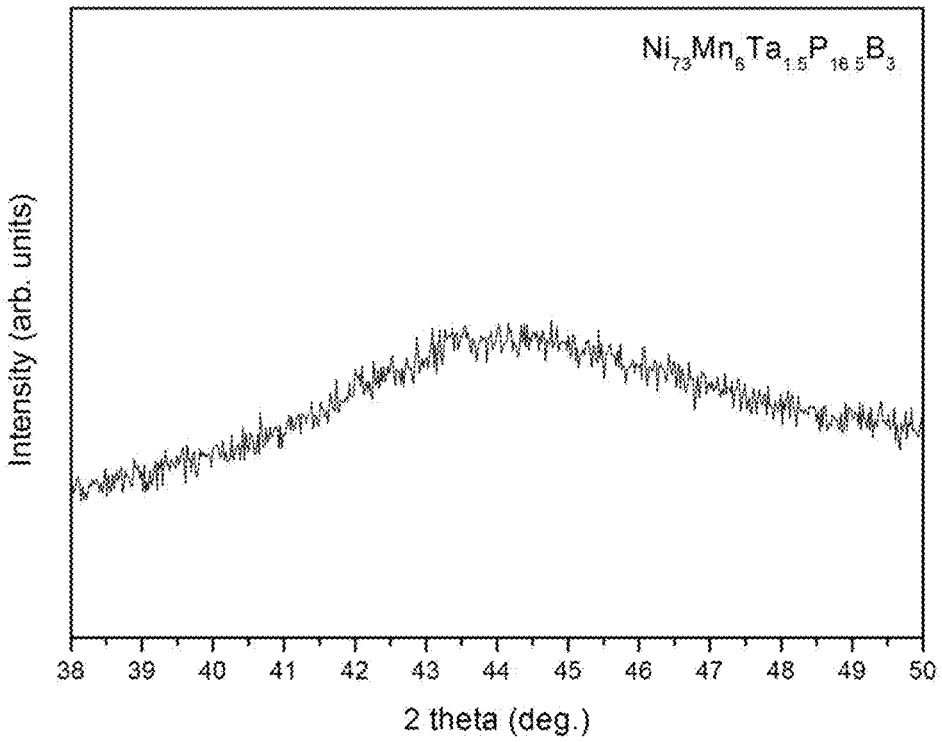
FIG. 21 provides an x-ray diffractogram verifying the amorphous structure of a 5 mm rod of sample metallic glass $Ni_{73}Mn_6Ta_{1.5}P_{16.5}B_3$, in accordance with an embodiment of the present disclosure.
Figure 22:
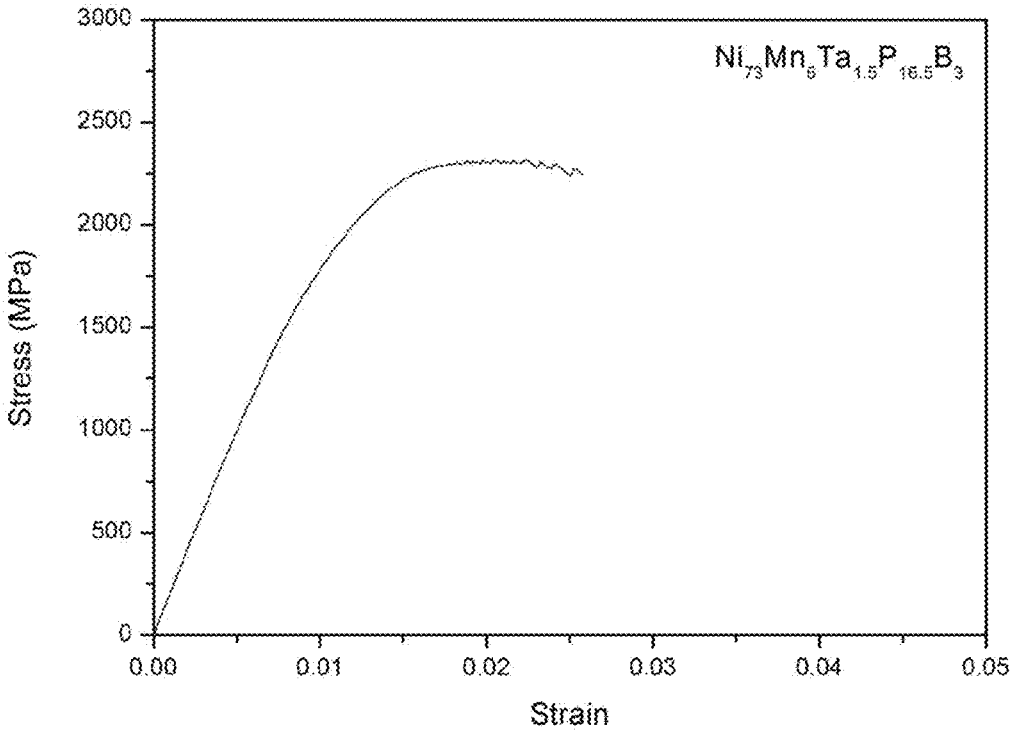
FIG. 22 provides a compressive stress-strain diagram for sample metallic glass $Ni_{73}Mn_6Ta_{1.5}P_{16.5}B_3$, in accordance with an embodiment of the present disclosure.

An image of a 5 mm diameter amorphous $Ni_{73}Mn_6Ta_{1.5}P_{16.5}B_3$ rod is shown in FIG. 20. An x-ray diffractogram taken on the cross section of a 5 mm diameter $Ni_{73}Mn_6Ta_{1.5}P_{16.5}B_3$ rod verifying its amorphous structure is shown in FIG. 21. The stress-strain diagram for sample metallic glass $Ni_{73}Mn_6Ta_{1.5}P_{16.5}B_3$ is presented in FIG. 22.

TABLE 10

Critical rod diameter, notch toughness, and yield strength of $Ni_{73}Mn_6Ta_{1.5}P_{16.5}B_3$ amorphous alloy

| Example | Composition | Critical Rod Diameter [mm] | Notch Toughness [MPa $m^{1/2}$] | Yield Strength [MPa] |
|---|---|---|---|---|
| 30 | $Ni_{73}Mn_6Ta_{1.5}P_{16.5}B_3$ | 5 | 86.8 ± 4.9 | 2315 |

Figure 23:
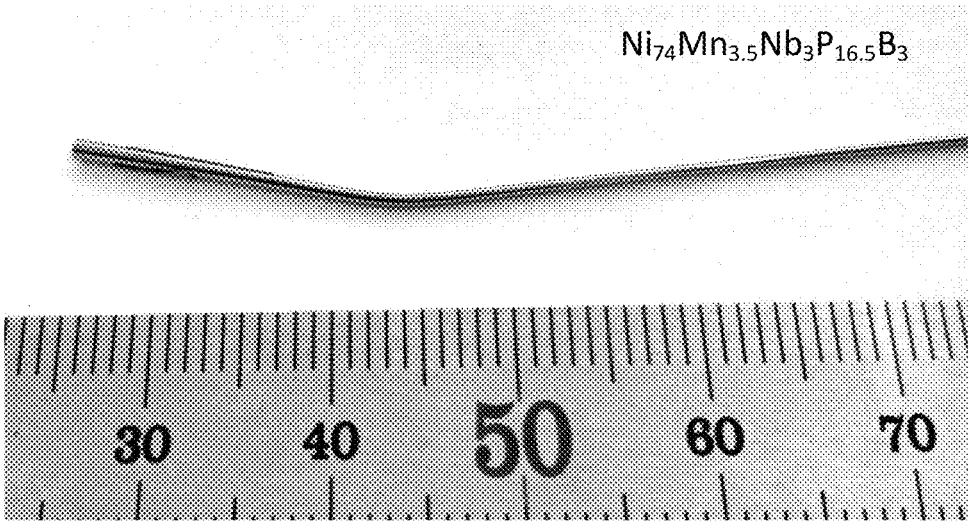
FIG. 23 provides an image of a plastically bent 1 mm amorphous rod of example metallic glass $Ni_{74}Mn_{3.5}Nb_3P_{16.5}B_3$.

Lastly, the alloys of the present disclosure exhibit a remarkable bending ductility. Specifically, under an applied bending load, the alloys are capable of undergoing plastic bending in the absence of fracture for diameters up to at least 1 mm. Images of amorphous plastically bent rods at 1-mm diameter section of example metallic glass $Ni_{74}Mn_{3.5}Nb_3P_{16.5}B_3$ are presented in FIG. 23.

Description of Methods of Processing the Sample Alloys

A method for producing the alloys involves inductive melting of the appropriate amounts of elemental constituents in a quartz tube under inert atmosphere. The purity levels of the constituent elements were as follows: Ni 99.995%, Mn 99.9998%, Nb 99.95%, P 99.9999%, and B 99.5%. A method for producing metallic glass rods from the alloy ingots involves re-melting the ingots in quartz tubes of 0.5-mm thick walls in a furnace at 1200° C. or higher, or more specifically between 1300 and 1400° C., under high purity argon and rapidly quenching in a room-temperature water bath. In general, amorphous articles from the alloy of the present disclosure can be produced by (1) re-melting the alloy ingots in quartz tubes of 0.5-mm thick walls, holding the melt at a temperature of about 1200° C. or higher, or more specifically between 1300 and 1400° C., under inert atmosphere, and rapidly quenching in a liquid bath; (2) re-melting the alloy ingots, holding the melt at a temperature of about 1200° C. or higher, or more specifically between 1300 and 1400° C., under inert atmosphere, and injecting or pouring the molten alloy into a metal mold. In a particular embodiment, the metal mold can be made of copper, brass, or steel. Optionally, prior to producing an amorphous article, the alloyed ingots can be fluxed with a reducing agent by re-melting the ingots in a quartz tube under inert atmosphere, bringing the alloy melt in contact with the molten reducing agent and allowing the two melts to interact for about 1200° C. or higher, or more specifically between 1300 and 1400° C., and subsequently water quenching.

Test Methodology for Measuring Notch Toughness

The notch toughness testing of sample metallic glasses was performed on 3-mm diameter rods. The rods were notched using a wire saw with a root radius of between 0.10 and 0.13 μm to a depth of approximately half the rod diameter. The notched specimens were placed on a 3-point bending fixture with span distance of 12.7 mm and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)).

Test Methodology for Measuring Yield Strength

Compression testing of exemplary metallic glasses was performed on cylindrical specimens 3 mm in diameter and 6 mm in length by applying a monotonically increasing load at constant cross-head speed of 0.001 mm/s using a screw-driven testing frame. The strain was measured using a linear variable differential transformer. The compressive yield strength was estimated using the 0.2% proof stress criterion.

The metallic glasses described herein can be valuable in the fabrication of electronic devices. An electronic device herein can refer to any electronic device known in the art. For example, it can be a telephone, such as a mobile phone, and a land-line phone, or any communication device, such as a smart phone, including, for example an iPhone®, and an electronic email sending/receiving device. It can be a part of a display, such as a digital display, a TV monitor, an electronic-book reader, a portable web-browser (e.g., iPad®), and a computer monitor. It can also be an entertainment device, including a portable DVD player, conventional DVD player, Blue-Ray disk player, video game console, music player, such as a portable music player (e.g., iPod®), etc. It can also be a part of a device that provides control, such as controlling the streaming of images, videos, sounds (e.g., Apple TV®), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the embodiments disclosed herein. Accordingly, the above description should not be taken as limiting the scope of the document.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed:

1. An alloy capable of forming a metallic glass represented by the following formula (subscripts denote atomic percentages):

$$Ni_{(100-a-b-c-d)}Mn_aX_bP_cB_d \quad (1)$$

where:

a is 0.25 to 15 b is between 0.5 and 10 c is between 12 and 21 d is between 1 and 6 wherein X is at least one of Nb and Ta, wherein the alloy has a critical rod diameter of at least 1 mm.

2. The alloy of claim 1, wherein the sum of c and d is between 18.5 and 20.5.

3. The alloy of claim 1, wherein the sum of c and d is between 19 and 20.

4. The alloy of claim 1, wherein X is Nb, a is between 0.25 and 5, b is between 1.5 and 4.5, c is between 15.25 to 17.75, and d is between 1.5 and 4.5.

5. The alloy of claim 1, wherein X is Nb, a is between 0.5 and 4.5, b is between 2 and 4, c is between 15.5 to 17.5, and d is between 2 and 4, and wherein the critical rod diameter is at least 2 mm.

6. The alloy of claim 1, wherein X is Nb, a is between 1 and 4, b is between 2 and 4, c is between 16 to 17, and d is between 2.25 and 3.75, and wherein the critical rod diameter is at least 3 mm.

7. The alloy of claim 1, wherein X is Nb, a is between 2.5 and 3.75, b is between 2.5 and 3.5, c is between 16.25 to 16.75, and d is between 2.5 and 3.5, and wherein the critical rod diameter is at least 4 mm.

8. The alloy of claim 1, wherein X is Ta, a is between 3 and 9, b is between 0.5 and 4.5, c is between 15.25 to 17.75, and d is between 1.5 and 4.5.

9. The alloy of claim 1, wherein X is Ta, a is between 4 and 8, b is between 0.5 and 4, c is between 15.5 to 17.5, and d is between 2 and 4, and wherein the critical rod diameter is at least 2 mm.

10. The alloy of claim 1, wherein X is Ta, a is between 4.25 and 7.75, b is between 0.5 and 3.5, c is between 16 to 17, and d is between 2.25 and 3.75, and wherein the critical rod diameter is at least 3 mm.

11. The alloy of claim 1, wherein X is Ta, a is between 4.5 and 7.5, b is between 0.5 and 3.25, c is between 16.25 to 16.75, and d is between 2.5 and 3.5, and wherein the critical rod diameter is at least 4 mm.

12. A metallic glass comprising an alloy of claim 1.

13. The metallic glass of claim 12, wherein the metallic glass has a notch toughness of at least 60 MPa $m^{1/2}$.

14. The metallic glass of claim 12, wherein the metallic glass has a yield strength of at least 2150 MPa.

15. A method of producing the metallic glass of claim 12 comprising:

melting the alloy into a molten state to form a melt; and quenching the melt at a cooling rate sufficiently rapid to prevent crystallization of the alloy.

16. The method of claim 15, further comprising fluxing the melt with a reducing agent prior to quenching.

17. The method of claim 15, wherein the reducing agent is boron oxide.

18. The method of claim 15, wherein the melt prior to quenching is heated to at least 1200° C.

* * * * *